US010542802B1

(12) United States Patent
Brown et al.

(10) Patent No.: US 10,542,802 B1
(45) Date of Patent: Jan. 28, 2020

(54) CASE FOR PORTABLE ELECTRONIC DEVICE

(71) Applicant: Incase Designs Corp., Chino, CA (US)

(72) Inventors: Jonathan Brown, Monrovia, CA (US); Steven Corraliza, North Miami Beach, FL (US); Eric James Hostetler, Orange, CA (US); William Ho, Chino Hills, CA (US)

(73) Assignee: Incase Designs Corp., Irvine, CA (US)

( * ) Notice: Subject to any disclaimer, the term of this patent is extended or adjusted under 35 U.S.C. 154(b) by 115 days.

(21) Appl. No.: 15/335,419

(22) Filed: Oct. 26, 2016

Related U.S. Application Data

(63) Continuation-in-part of application No. 29/546,705, filed on Nov. 24, 2015, now Pat. No. Des. 808,372, and a continuation-in-part of application No. 29/546,706, filed on Nov. 24, 2015, now Pat. No. Des. 808,373.

(60) Provisional application No. 62/246,554, filed on Oct. 26, 2015.

(51) Int. Cl.
*A45C 11/00* (2006.01)
*A45F 5/00* (2006.01)

(52) U.S. Cl.
CPC ..... *A45C 11/00* (2013.01); *A45F 5/00* (2013.01); *A45C 2011/001* (2013.01); *A45C 2011/002* (2013.01); *A45C 2011/003* (2013.01)

(58) Field of Classification Search
CPC ..... A45C 11/00; A45C 2011/001; A45C 2011/002; A45C 2011/003; A45F 5/00
USPC ..... 206/320, 45.24, 45.2, 45.23
See application file for complete search history.

(56) References Cited

U.S. PATENT DOCUMENTS

| | | | | |
|---|---|---|---|---|
| 8,706,176 | B1 * | 4/2014 | Jia | H04M 1/185 206/305 |
| 10,076,168 | B2 * | 9/2018 | Sirichai | A45C 11/00 |
| 2010/0300909 | A1 * | 12/2010 | Hung | H04M 1/04 206/320 |
| 2014/0202899 | A1 * | 7/2014 | Murchison | H05K 5/0013 206/320 |

* cited by examiner

*Primary Examiner* — Steven A. Reynolds

(57) ABSTRACT

A case for a portable electronic device that includes a rigid outer layer and a more flexible inner layer. The case is a single piece. The outer layer has openings that extend through the thickness of the outer layer. The openings are connected by a groove in the outer layer. The openings and the groove can be filled by a more flexible material. The inner layer has openings. The outer layer is translucent so that the inner layer may be visible through the outer layer.

9 Claims, 26 Drawing Sheets

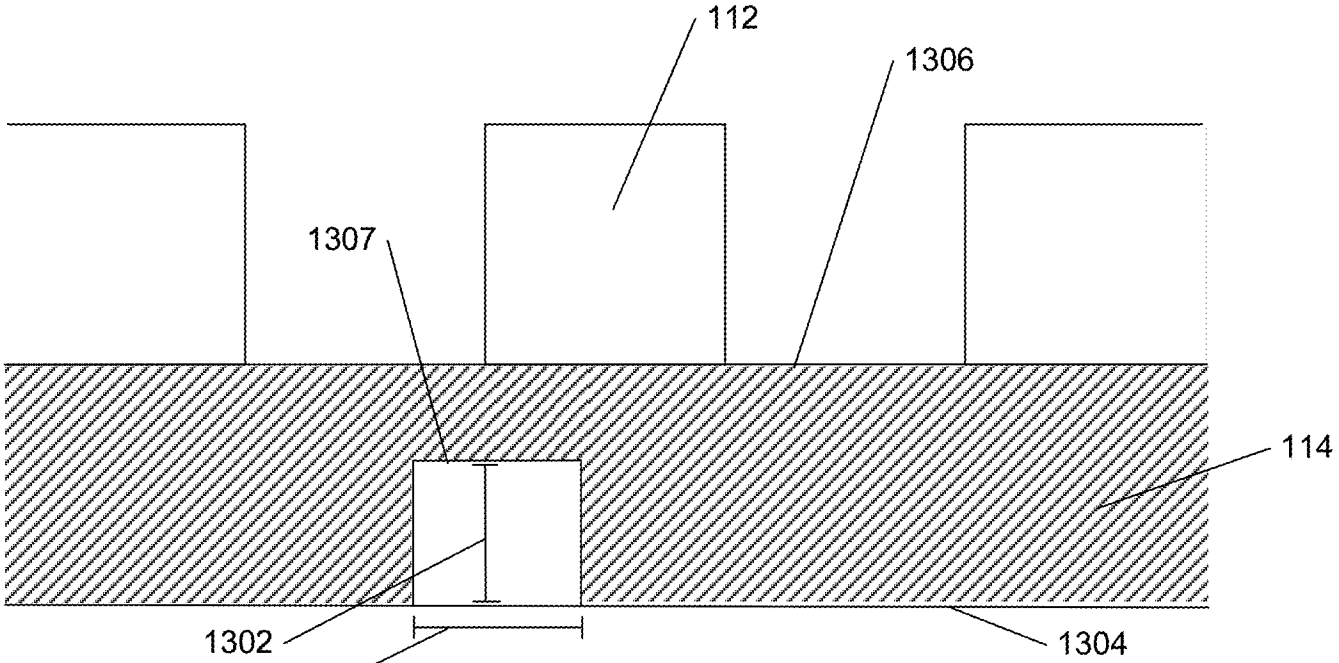
Figure 13A
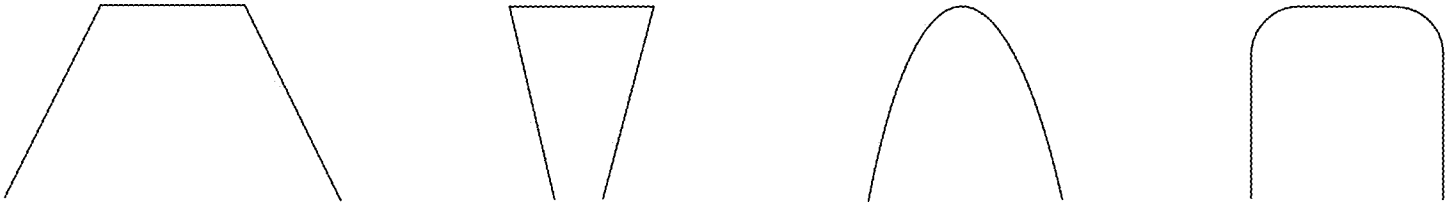
Figure 13B
Figure 13C
Figure 13D
Figure 13E

CASE FOR PORTABLE ELECTRONIC DEVICE

CROSS-REFERENCE TO RELATED APPLICATIONS

This patent application is a continuation in part of U.S. patent application Ser. Nos. 29/546,705 and 29/546,706, filed Nov. 24, 2015, and claims the benefit of U.S. patent application 62/246,554, filed Oct. 26, 2015. These applications are incorporated by reference along with all other references cited in this application.

BACKGROUND OF THE INVENTION

The present invention generally relates to cases for electronic devices, especially portable devices like smartphones and tablets. There are many types of electronic devices including personal digital assistants (PDAs), computers, laptop computers, smartphones, mobile phones, satellite phones, cellular phones, pagers, music player, MP3 players, media players, digital cameras, video cameras, bar code scanner, global positioning system (GPS), and portable game consoles.

These portable electronic devices allow people to play and record music, send and receive e-mail, send text messages, browse Web pages, make phone calls, play and record video, take and view pictures, edit documents, and much more. These devices continue to revolutionize the way people interact, learn, connect with other people, conduct business, and find things. They help people manage their daily lives and can be a source of entertainment. These devices can be used to store valuable information including personal information (e.g., phone numbers, financial information, private photos or videos, and favorite music tracks).

Typically these devices are intended to be carried or moved about. As such, these devices are more vulnerable to damage as compared to nonportable devices. These devices are more likely to be accidentally dropped, hit, or scratched. Some types of damage may be cosmetic (e.g., scratch). However, other types of damage may ruin or limit the functionality of the device. Often these devices contain sensitive and fragile components (e.g., screen, camera lens, flash, processors, accelerometers, and sensors). Accidentally dropping the device could render various features unusable.

Therefore, it is desirable to protect the electronic device while still allowing features of the device to be easily accessed.

BRIEF SUMMARY OF THE INVENTION

A case for a portable electronic device that includes a rigid outer layer and a more flexible inner layer. The case is a single piece. The inner layer has openings. The outer layer is translucent so that the inner layer may be visible through the outer layer.

In an implementation, a case for a portable electronic device includes: a base portion of the case includes a first layer, where the first layer includes an interior surface and an exterior surface; first, second, third, fourth sidewalls connected to the base portion, where the first, second, third, and fourth sidewalls surround the electronic device, and the first and third sidewalls are shorter than the second and fourth sidewalls; a groove, formed in the first layer in the back portion, where the groove extends from the exterior surface of the first layer toward the interior surface of the first layer a first depth at a groove bottom surface, where the groove includes a first width, the groove extends from a first end to a second end, and first end is opposite to the second end.

The case includes: a first opening, formed in the first layer in the back portion, where the first opening includes a second width and a second depth, the second depth extends from at least the exterior surface of the first layer to the interior surface, the first opening includes a third end and a fourth end, and the third end is connected to the first end of the groove; and a second opening, formed in the first layer in the back portion, where the second opening includes a third width and a third depth, the third depth extends from at least the exterior surface of the first layer to the interior surface, the first opening includes a fifth end and a sixth end, and the fifth end is connected to the second end of the groove.

Other features and advantages of the present system will become apparent upon consideration of the following detailed description and the accompanying drawings, in which like reference designations represent like features throughout the figures.

BRIEF DESCRIPTION OF THE DRAWINGS

FIG. 13A shows a cross section of the base that includes the channel.

FIGS. 13B-13E show various implementations of the channel.

DETAILED DESCRIPTION OF THE INVENTION

FIGS. 1-7 show an implementation of a case 100 for an electronic device. Specific implementations of cases incorporating aspects of the invention may be manufactured by Incase Designs Corp. and known as the Smart SYSTM Case, which is a trademark of Incase.

The Smart SYSTM Case provides smarter protection by design through a low profile, dual-layer construction that maintains the device's minimal profile. A durable hardshell exterior is co-molded with a soft, impact-absorbing inner layer for complete protection in a flexible, secure, and lightweight form. A specific implementation of the Smart SYSTM Case is for the iPhone by Apple Inc., and more specifically the iPhone 6, iPhone 6s, iPhone 6 Plus, and iPhone 6s Plus.

Features of the Smart SYSTM Case include: textured exterior enhances grip, raised bezel around perimeter keeps screen protected while the durable hardshell exterior provides surface protection, flexible interior lining absorbs impact and distributes shock, precision engineered design provides full access to all ports and control. More specifically, the durable exterior is co-molded with a soft, impact-absorbing inner layer for complete protection. The flexible material that covers the buttons is just the right thickness so you can still easily activate the phone.

The case is a one-piece case. This is in contrast to a two-piece, such as the Incase Slider Case. In a two-piece case, there are two pieces that are separated so that the phone can be inserted into the case. Then the case is reassembled again. For the one-piece case of this application, to use the case, a person inserts the phone and flexes the edges or sidewalls of the case to extend around the edges of the phone. The case includes cutouts and buttons so the user can access the control features and ports of the phone without taking the phone out of the case.

Figure 2A:
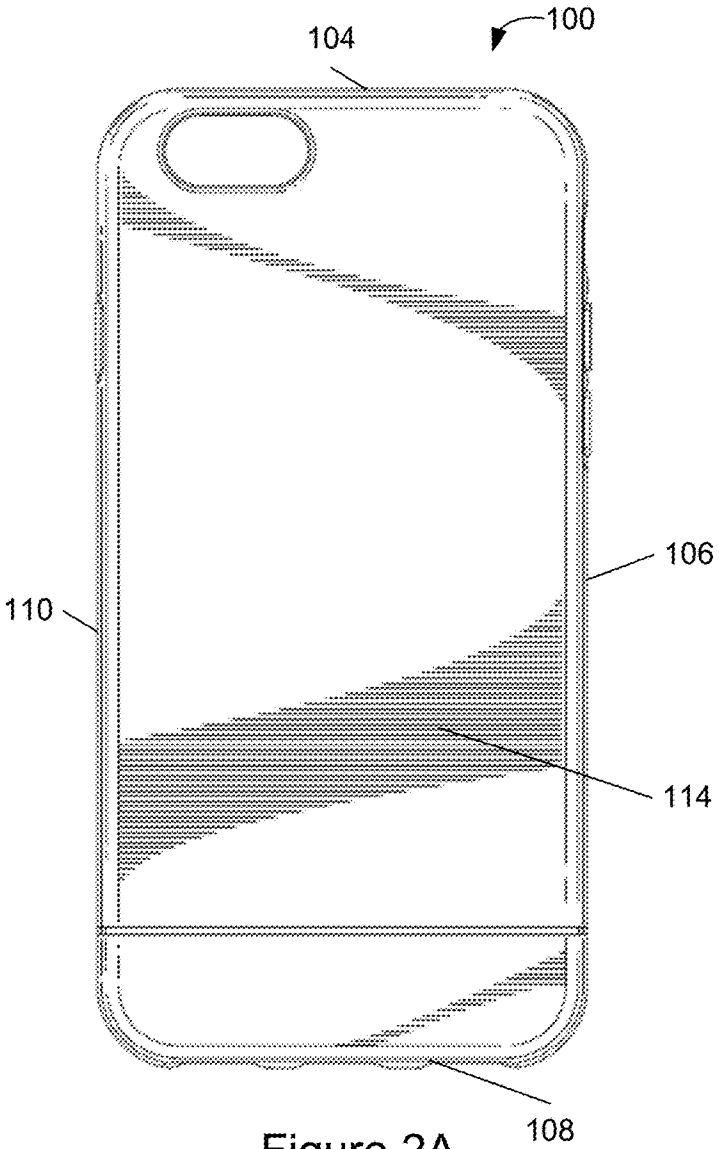
FIG. 2A shows a back view of the case.
Figure 1:
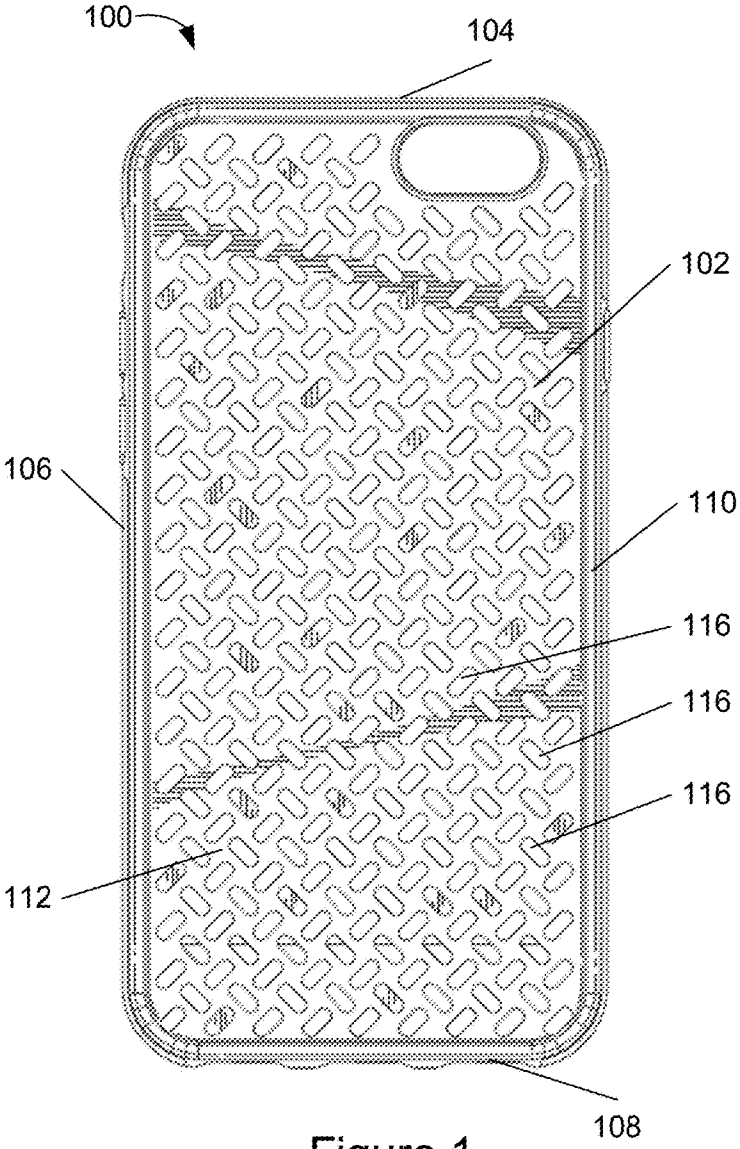
FIG. 1 shows a front view of the case.
Figure 2B:
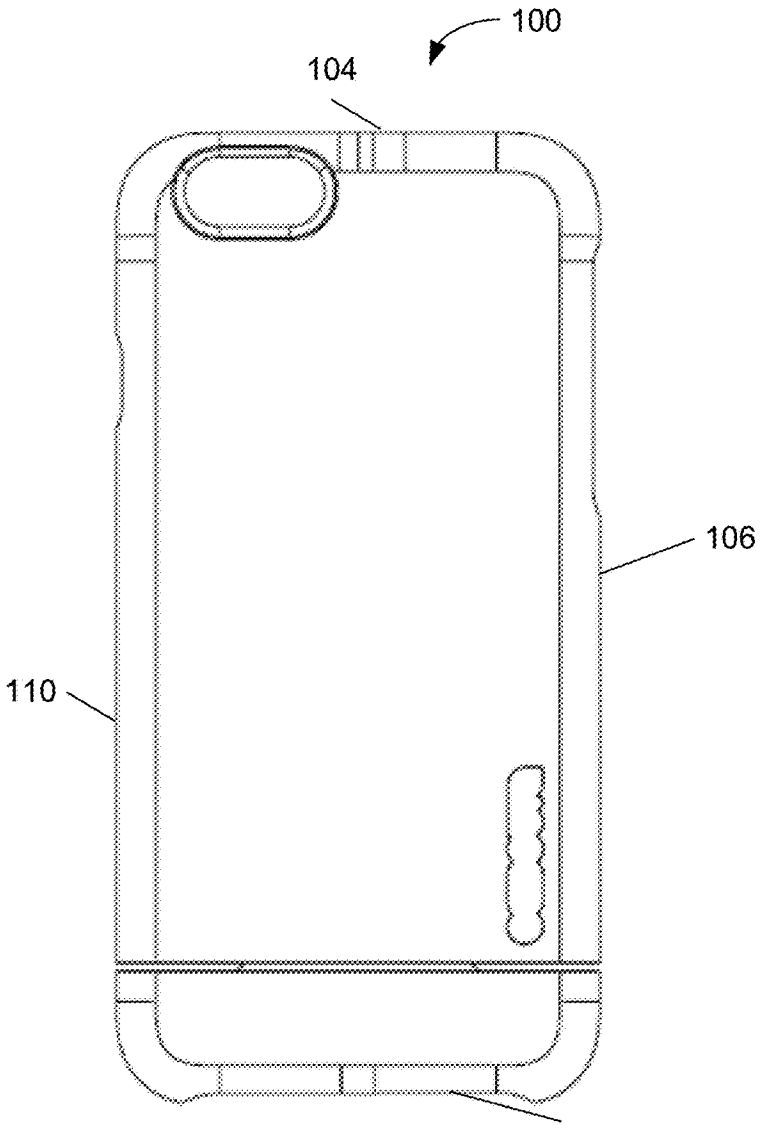
FIG. 2B shows another implementation of the back view of the case.
Figure 3:
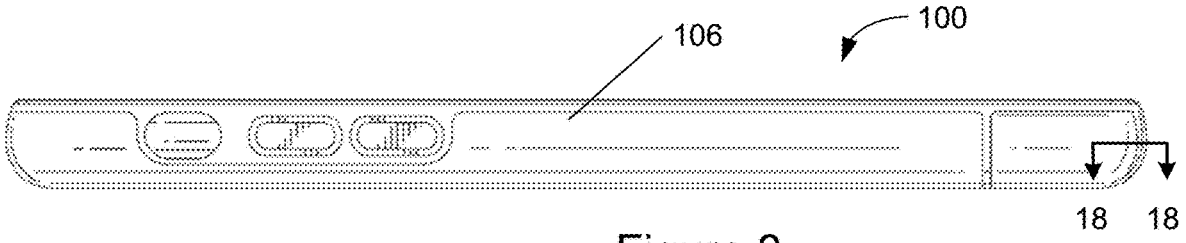
FIG. 3 shows a left side view of the case.
Figure 4:
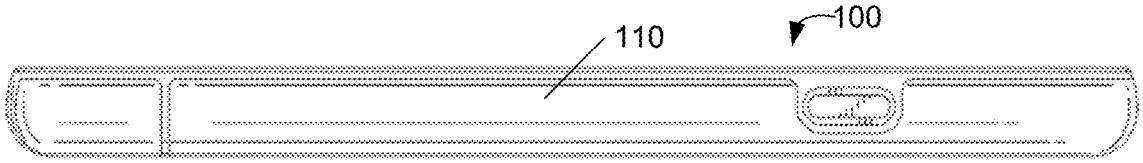
FIG. 4 shows a right side view of the case.
Figure 5:
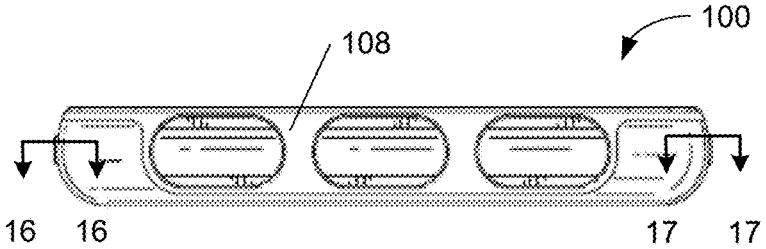
FIG. 5 shows a bottom view of the case.
Figure 6:
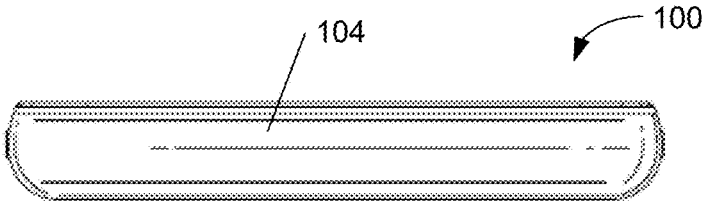
FIG. 6 shows a top view of the case.
Figure 7:
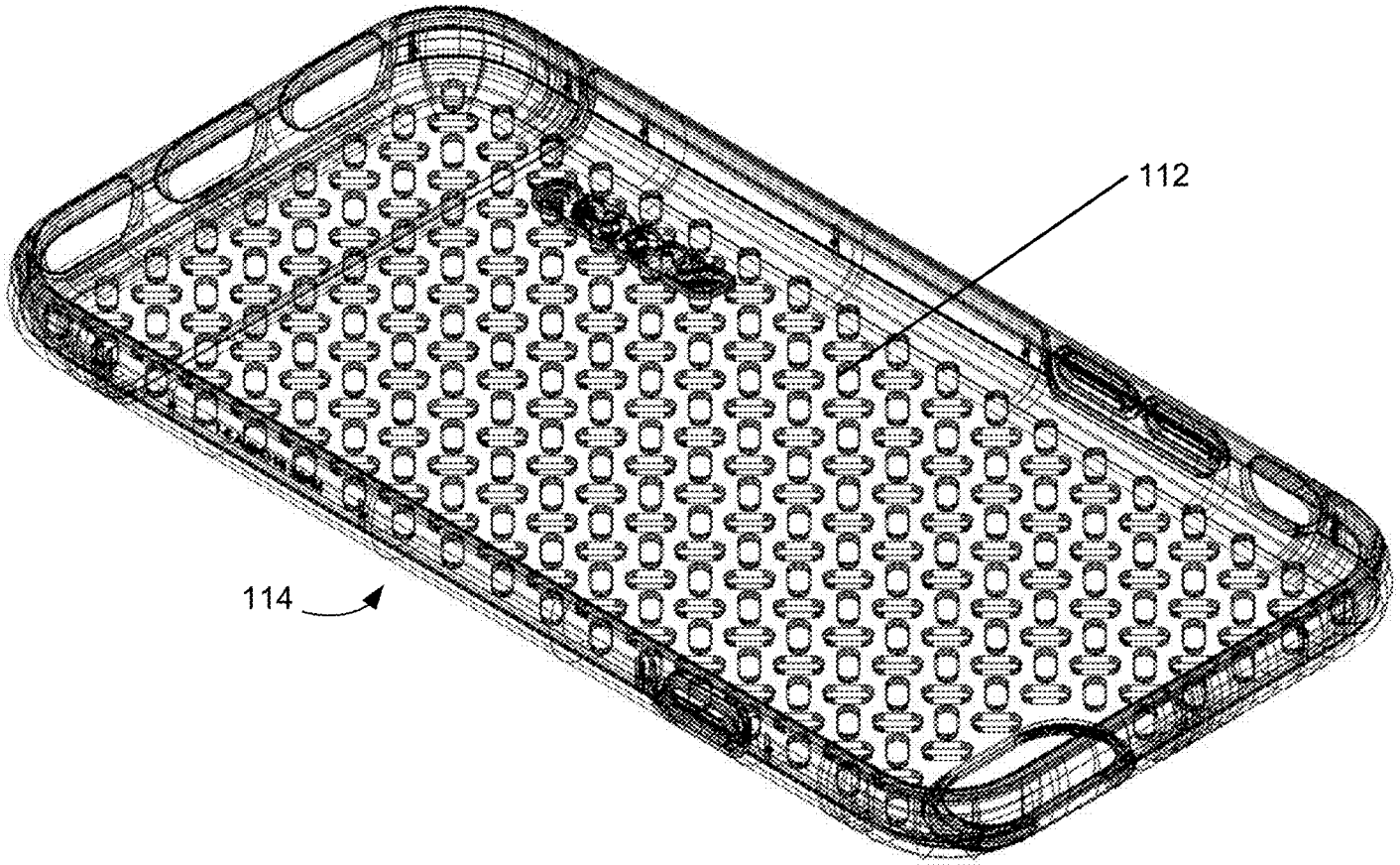
FIG. 7 shows a perspective view of the case with contour lines.

FIG. 1 shows a front view of the case. FIG. 2A shows a back view of the case. FIG. 2B shows another implementation of the back view of the case. FIG. 3 shows a left side view of the case. FIG. 4 shows a right side view of the case. FIG. 5 shows a bottom view of the case. FIG. 6 shows a top view of the case. FIG. 7 shows a perspective view of the case with contour lines.

The case includes a base 102 (or back portion) upon which a back of the electronic device will be placed against. A first (or top) sidewall 104 and second (or left) sidewall 106 are connected to the base. The first sidewall is adjacent to the second sidewall. A third (or bottom) sidewall 108 is connected to the base at an end opposite to the first sidewall. A fourth (or right) sidewall 110 is connected to the base at an end opposite of the second sidewall.

Dual Layers. The base includes a first (or inner) layer 112 and a second (or outer) layer 114, connected to the first layer.

The first and second layers may be produced separately (e.g., through injection molding, compression molding, or more) and then connected together, such as through adhesive. In another specific implementation, the first layer is "comolded" to the second layer, where a first material for the first layer is poured into a mold for the case and after the first material has partially set, a second material for the second layer is poured into the mold. In another specific implementation, the second layer is comolded to the first layer.

Dual Layers—Materials and Hardness of Materials. The first and second layers may be polycarbonate (PC), gel, silicone, rubber, thermoplastic polyurethane (TPU), thermoplastic elastomer (TPE), thermoplastic rubber (TPR), fiberglass, carbon fiber, polymethyl methacrylate (PMMA or acrylic glass) or many others, or a composite or combination of these. For example, the first layer is TPU and the second layer is PC.

As another example, the first layer can have a first durometer and the second layer can have a second durometer. The second durometer may be greater than the first durometer so the second layer may be harder than the first layer. The second durometer may be about 75 on a type D scale which is about the value for hard plastic. The first durometer may be about 50 which is about the value for rubber or solid truck tires on the type D scale.

Dual Layers—Translucence and Pattern of Openings. In an implementation, the second layer (outer or exterior layer) is a translucent hard plastic, where light can shine through the material. The first layer (inner layer), which is bonded to the second layer, is a nontranslucent elastic material (e.g., TPU). For the case, light will shine through the translucent hard plastic but not through the nontranslucent elastic material. The nontranslucent elastic material can be patterned, such as to have a geometric pattern (see FIG. 1), lettering, shapes, or other. Then for the case, light will shine any openings in the pattern of the nontranslucent material and be visible through the translucent material. For example, the back of the phone can be seen through the translucent material through the openings in the nontranslucent material (see figure A10).

In other implementations, both the first layer is nontranslucent or opaque and the second layer is nontranslucent. The first layer and second layers are both translucent, and the first and second layers can have differing levels of translucence. The first layer is nontranslucent and the second layer is translucent.

The first or second or both layers may have openings 116 in a pattern. The pattern can include an alternating crisscross of obround-shaped openings. The resulting patterns appear like a industrial metal sheet with texture pattern such as a rigidized steel sheet with embossed raised pattern or "lug." Alternatively, the pattern may be a perforated pattern including holes. In another implementation, a first opening is arranged in a first direction and a second opening is arranged in a second direction, transverse to the first direction. And the arrangement of the first and second openings is repeated in a pattern.

For example, in the implementation shown in FIGS. 1-2, the first layer has openings and the second layer has no openings. In another implementation, the first layer has no openings and the second layer has openings. The openings can act as compressible air gaps similar to air-filled bags in shipping containers and protect the electronic device from impact. The openings can be elongated ovals (such as the openings shown in FIG. 1), circles, triangles, squares, other polygons, or any composite or combination of these. The openings can be arranged in a regular pattern. For example, the elongated oval openings in FIG. 1 are arranged in a "T" shape where a vertical portion and a horizontal portion of the T shape are separated by a gap, and the T shape is repeated in a regular pattern. In another implementation, the openings can be arranged in an irregular pattern. For example, the first layer may have openings located along the first sidewall. Or the openings may be distributed nonuniformly across the first layer or second layer.

The openings provide texture such that the case grips the electronic device so that the electronic device does not inadvertently slide out of the case.

Figure 8:
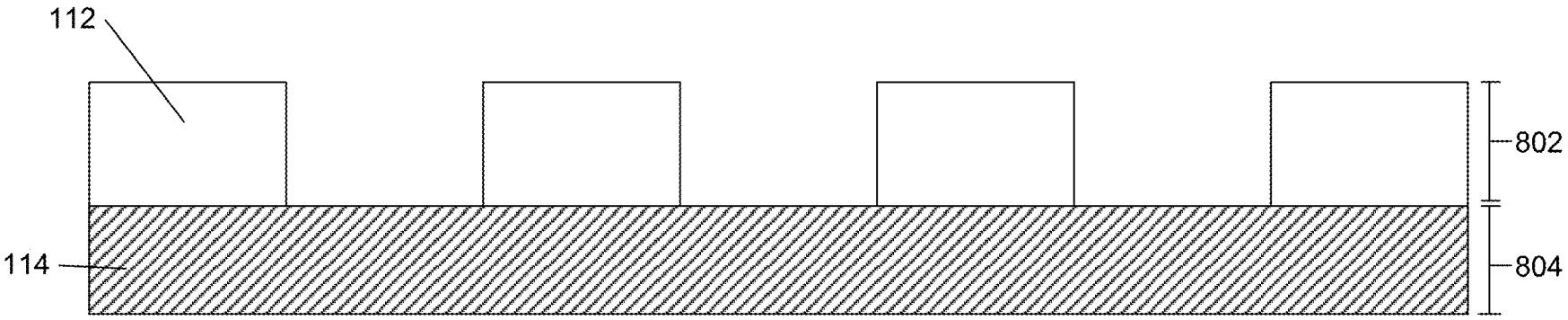
FIG. 8 shows a cross-sectional view of the first and second layers.

Dual Layers—Ratios of Thicknesses. FIG. 8 shows a cross-sectional view of the first and second layers. The first layer can have a first thickness 802 and the second layer can have a second thickness 804. For example, a first thickness to second thickness ratio may be approximately 10:1, 8:1, 5:1, 4:1, 3:1, 2:1, 1:1, 1:2, 1:3, 1:4, or 1:10. Depending on the electronic device to be used with the case, different ratios may be used. For example, if the electronic device is made of a material that tends to shatter when dropped or brittle, then a ratio with a thicker layer of a lower durometer (or softer) material may be desired because the softer material can slow down an impact more than a harder material can, and protect a phone made of more brittle material.

Hinge—Positions of TPU Buttons Line Up Opposite Each Other. The first, second, third, and fourth sidewalls may be polycarbonate (PC), gel, silicone, or rubber, silicone, thermoplastic polyurethane (TPU), thermoplastic elastomer (TPE), thermoplastic rubber (TPR), fiberglass, carbon fiber, or many others, or a composite or combination of these. As an example, a sidewall may have more than one section and each section may have different compositions of materials.

Figure 9:
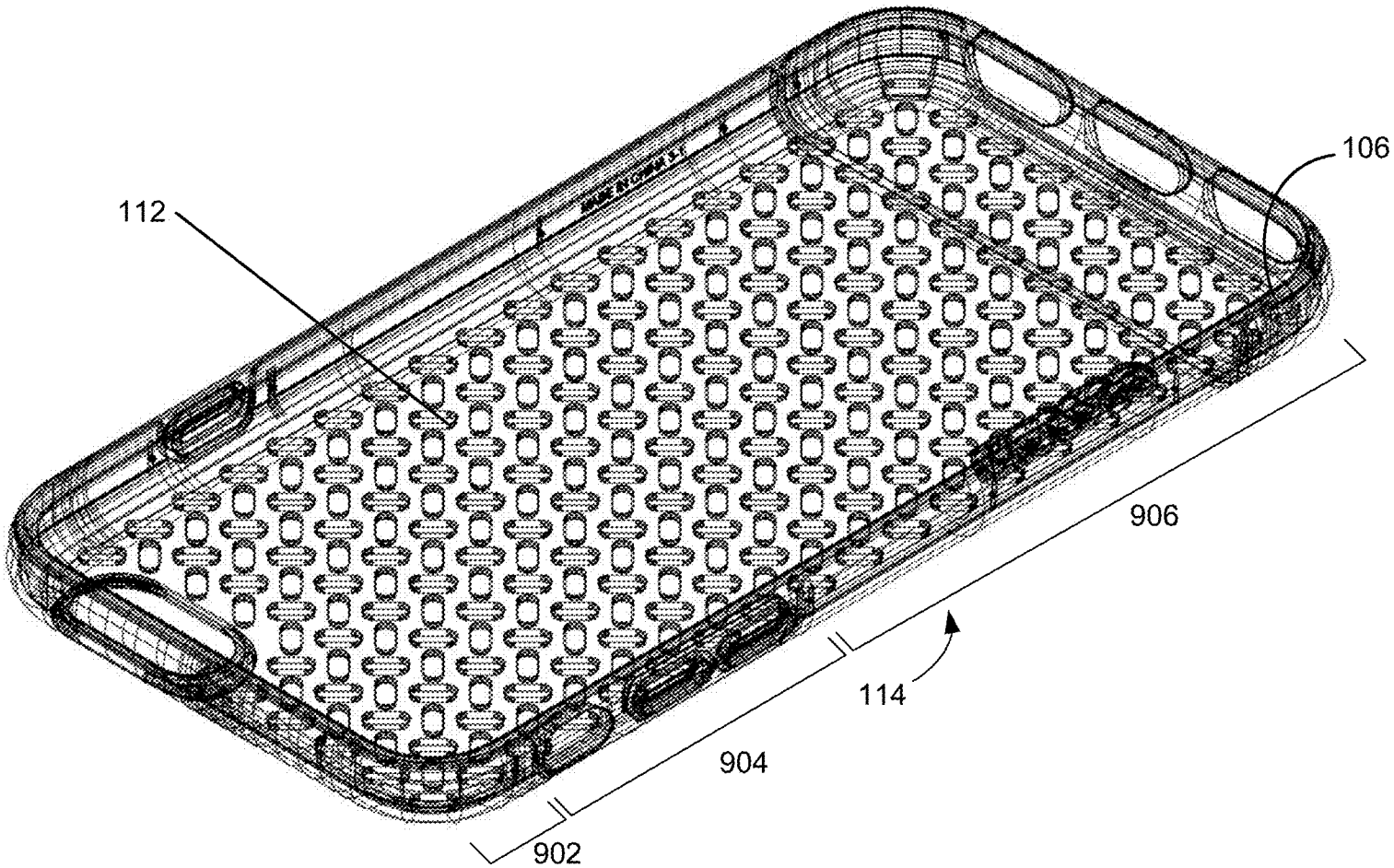
FIG. 9 shows a case with a specific implementation of sections of the second sidewall.

FIG. 9 shows a case with a specific implementation of sections of the second sidewall. In a specific example, the second sidewall includes a first section 902, a second section 904, and a third section 906. The first and third sections include a layer of polycarbonate and thermoplastic polyurethane. The second section includes thermoplastic polyurethane and less polycarbonate compared to the first and third sections. Because the second section is made of more flexible material, the second section can be moved (e.g., bend or stretch around) more relative to its less flexible adjacent sections. Having a more flexible section between more rigid sections helps a user place a phone (or other electronic device) in a rigid one piece case more easily. With multiple flexible sections in the sidewalls of the case, the user can more easily place the phone inside the case.

The case can have openings or covered buttons for features of the smartphone or electronic device. For example, some features of the smartphone or electronic device include controls (e.g., buttons, switches, or more) along a left or right side edge, or both, of the phone to sleep or wake the phone, turn on or off the phone, or to adjust the volume. Other features of electronic device is ports for audio jacks, lightning port, or universal serial bus (USB) or mini USB cables, or combination of these.

Figure 10:
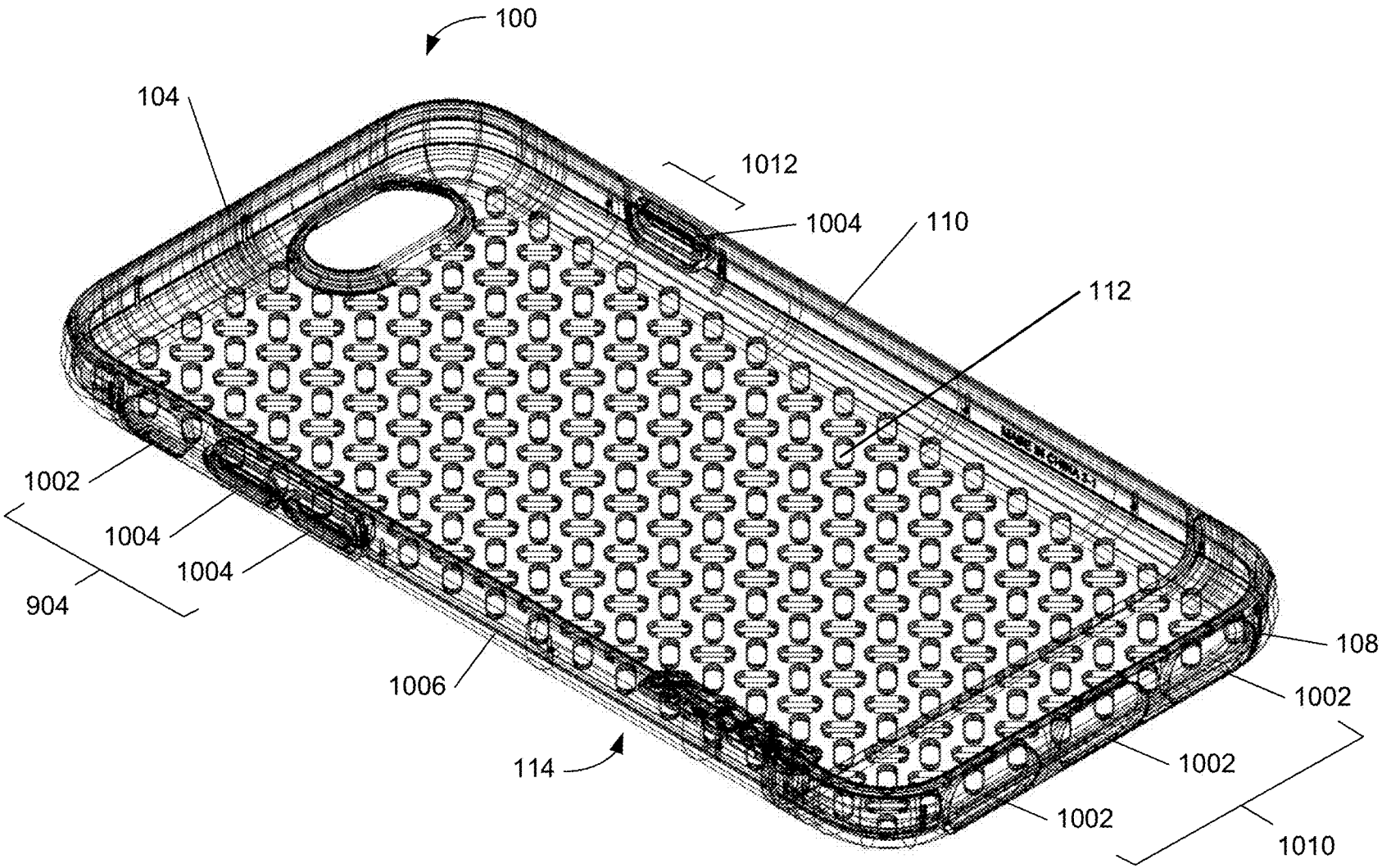
FIG. 10 shows an implementation of a case with one or more holes in the sidewalls to allow a user access to the controls or ports while the electronic device is in the case.

FIG. 10 shows an implementation of a case with one or more hole 1002 in the sidewalls to allow a user access to the controls or ports while the electronic device is in the case. The case may also include one or more protrusion 1004 on a sidewall that is adjacent to a button of the electronic device. When the user presses the protrusion, the protrusion pushes on the button, thereby activating the function controlled by the button. With the protrusion, the button can be used while the button is within the case, and is not exposed.

A section of a sidewall that includes a protrusion or a hole may have a composition of mostly (or more than 50 percent) thermoplastic polyurethane. For example, section 904 of the second sidewall includes hole 1002 and protrusions 1004 and has a composition of approximately 100 percent thermoplastic polyurethane. Section 1010 of the third sidewall includes hole 1002 and has a composition of approximately 100 percent thermoplastic polyurethane. Section 1012 of the fourth sidewall includes hole 1002 and protrusions 1004 and has a composition of approximately 100 percent thermoplastic polyurethane.

Figure 11:
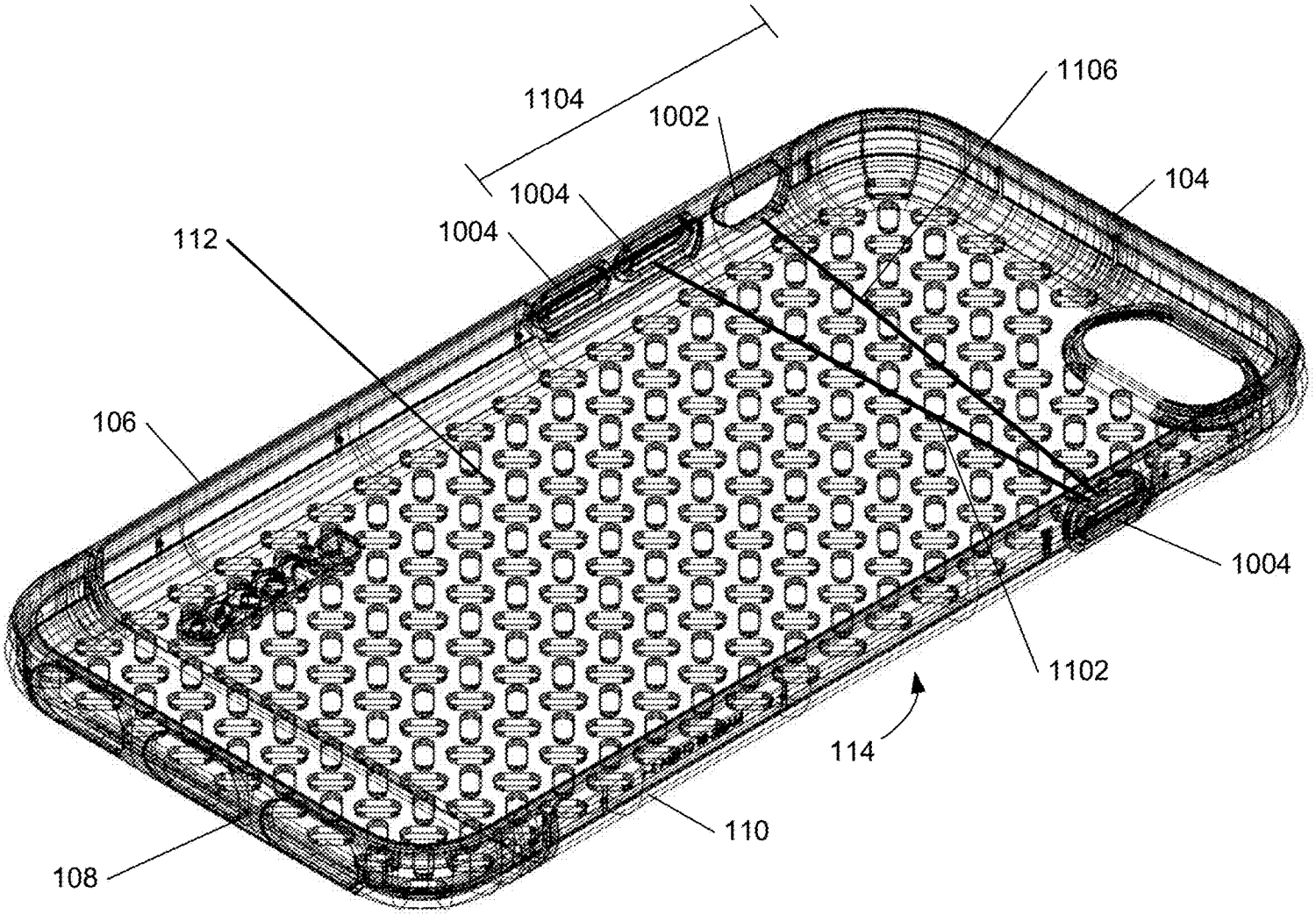
FIG. 11 shows an implementation of a case with lines of increased flexibility between protrusions and holes across the base.

FIG. 11 shows an illustration of lines of increased flexibility between protrusions and holes across the base of case 100. When two areas of a case are more flexible and positioned in proximity to each other, a more rigid area of the case that is positioned between the two more flexible areas becomes more flexible.

In case 100, the increased flexibility of a rigid layer of the base are created by protrusions and holes made of more flexible materials that are positioned approximately opposite each other across the base. For example, a protrusion (any of the two protrusions) on the second sidewall is approximately opposite (across the base) to the protrusion on the fourth sidewall. And a hole on the second sidewall is also approximately opposite (across the base) to the protrusion on the fourth sidewall.

A line of increased flexibility shows an example of an axis of rotation for bending the rigid layer of the base. The line extends across the base and between protrusions, holes, or any combination of these and can act as a hinge (or axis of rotation). For example, a line 1102 extends from a protrusion (any of the two protrusions) on the second sidewall to the protrusion on the fourth sidewall. Line 1102 is approximately a distance 1104 of 30 millimeters to 40 millimeters from the first sidewall. The distance may vary depending on the distances apart between protrusions, holes, or any combinations of these. In another example, a line 1106 extends from a hole 1102 on the second sidewall to protrusion 1004 on the fourth sidewall. The user can more easily bend or flex the case about lines 1102 and 1106, which acts like a hinge. The softer the material that the protrusions and holes are made of, the more easily the user can bend the case about the line.

In addition to lines of increased flexibility that extend between more flexible areas on opposite sidewalls, lines of increased flexibility can also extend between more flexible areas on adjacent sidewalls or on opposite corners.

Flex Line. FIG. 12A shows a case 1200 with a channel 1202 that divides the outer layer into two pieces, upper portion 1208 and lower portion 1210. The upper portion has a greater area than the lower portion. The channel (or groove) is filled with the inner layer material, which extends from the inner layer toward the outer surface of the outer layer to fill the channel. The inner layer material is flush with the outer surface of the outer layer.

By using the elastic inner layer to split the hard outer layer into two portions, this increases the flexibility of the case, so that the case is easier to flex, which allows the user to more easily insert a phone into the case (without cracking the case).

In another implementation, the upper portion has a smaller area than the lower portion so that the case can be flexed at a different position when inserting the electronic device into the case.

A length 1204 of the channel may extend from one sidewall to an opposite sidewall. For example, FIG. 12A shows an implementation of the length of the channel extending from the second sidewall to the fourth sidewall. In other implementations, the length of the channel may extend from the first sidewall to the third sidewall, across the base between sidewalls (e.g., from one sidewall to an adjacent sidewall), corners (e.g., from one corner to an opposite corner), or any combinations of these. In other implementations, the channel may extend from a sidewall and terminate at an intermediate point before reaching an opposite sidewall. In specific implementations, the length may be approximately 5, 6, 7, 8, 10, 15, 20, or 30 centimeters. In other implementations, the channel may extend from a first distance from a sidewall and terminate at a second distance from the sidewall.

The channel may have a thickness 1206 that is approximately 1 or 2 millimeters. In other implementations, the channel can be thicker, such as 3, 4, 5, or 6 millimeters. A thicker channel can increase flexibility of the case. With increased flexibility of the case, the user can insert a phone into the case more easily. In other implementations, the channel can be thinner, such as 0.3, 0.5, or 0.7 millimeters, which can decrease flexibility of the case. A less flexible case can prevent the electronic device from slipping out of the case.

Figure 12B:
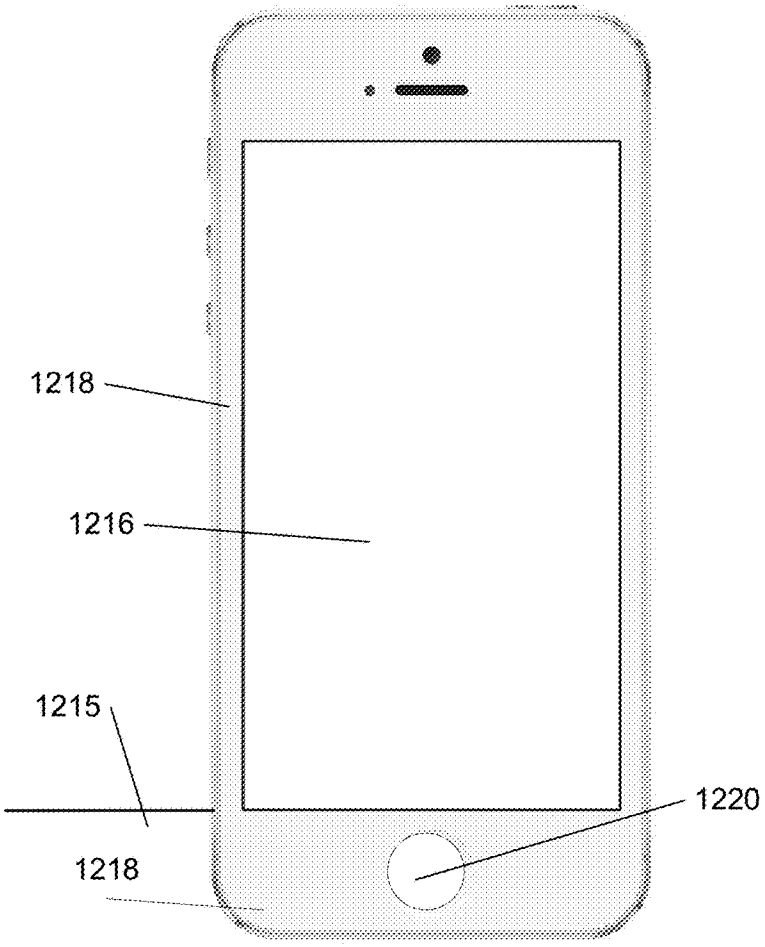
FIG. 12B shows a picture of a phone that can fit into the case of FIG. 12A.
Figure 12A:
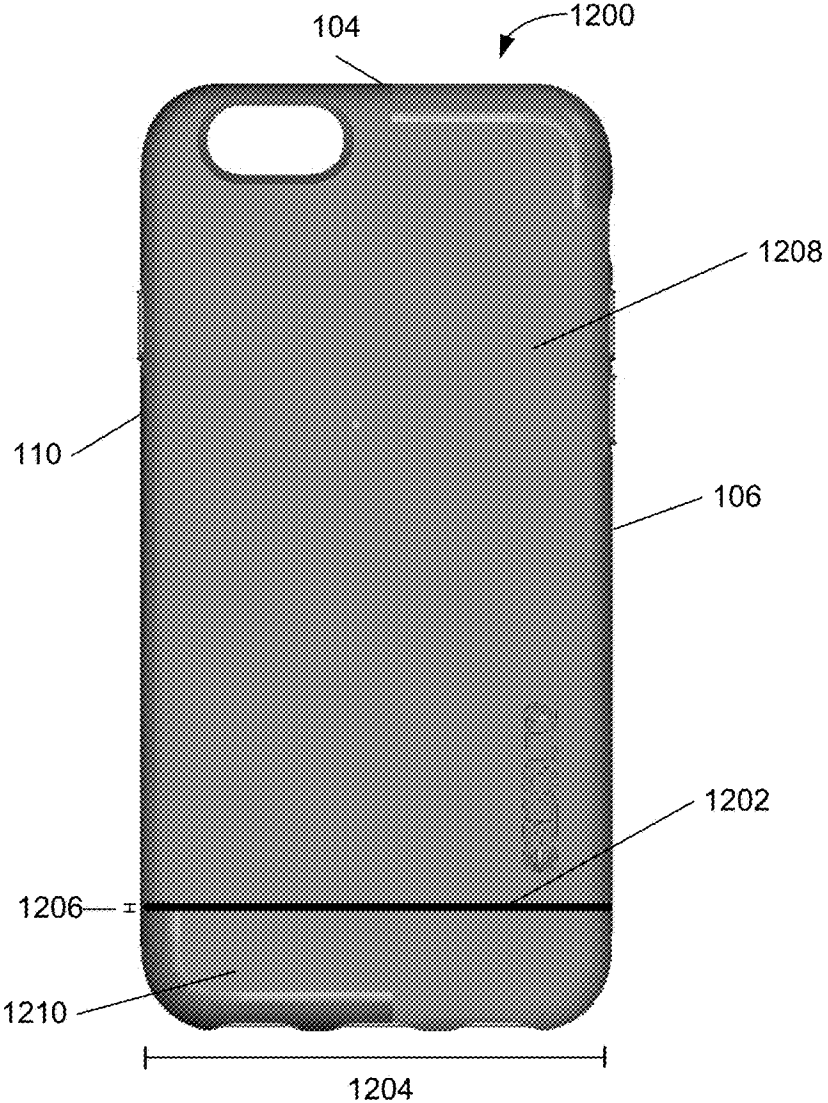
FIG. 12A shows an implementation of a case that includes a channel in the second (or outer) layer of the base.

FIG. 12B shows a picture of an electronic device, more specifically a smartphone, that can fit into the case shown in FIG. 12A. A line 1215 shows an approximate boundary line between a glass assembly 1216 and a frame 1218 of the phone, which includes a home button 1220. The channel in the case is placed at a position that aligns with the boundary line. For example, a top edge or bottom of the channel will be aligned with the boundary The channel can help the user orient the case when placing the phone in the case. The channel is visible to the user from the front and the back side of the case. The channel can be seen at the sidewalls of the case, which is visible from the front of the case. The channel is also visible across the back of the case. In the implementation shown in FIG. 12A, the channel is closer to the bottom sidewall of the case, matching with line 1215 of the phone. To place the phone in the correct orientation relative to the case, the user can place the phone into the case such that the channel lines up to line 1215.

FIG. 13A shows a cross section of the base that includes the channel. A depth 1302 extends from an outer surface 1304 of the second (or outer or exterior) layer and terminates before reaching an inner surface 1306 of the second layer. In other implementations, the depth of the channel may extend completely through the second layer. In FIG. 13A, the cross-sectional shape of the channel is rectangular, and one dimension of the rectangle is equal to depth 1302.

In another implementation, the case includes a back portion of the outer or exterior layer (e.g., polycarbonate or PC) and a left sidewall (or left side portion) of the outer layer. The left sidewall is connected to the back side portion at a first edge of the back portion. The case includes a right sidewall (or right side portion) of the outer layer. The right sidewall is connected to the back side portion at a second edge of the back portion. The second edge is opposite to the first edge.

The case also includes the channel (or a groove), formed in the outer layer in the back portion, where the groove extends from the outer (or exterior) surface 1304 of the outer layer toward the inner or (interior) surface 1306 of the outer layer a first depth (or depth 1302) at a groove bottom surface 1307, where the first depth is less than a thickness of the outer layer from the exterior surface to the interior surface, and the groove has a first width 1310.

In a specific implementation, the groove has walls that are transverse or vertical relative to a surface of the outer layer. And a bottom surface of the groove is parallel to the surface of the outer layer. However, in other implementations, groove can have wall that are angled different with respect the surface of the outer layer or the bottom groove surface.

FIGS. 13B-13E show various implementations of the channel. For example, FIG. 13B shows a channel with cross-sectional shape of trapezoid. FIG. 13C shows an inverted trapezoid shape. FIG. 13D shows a partial oval. FIG. 13E shows a rectangle with rounded corners. The sizes of the shapes or dimensions (e.g., depth 1302) can be adjusted to increase or decrease flexibility. In other implementations, the groove can be V shaped, U shaped, semicircular shaped, and many others. The angle of the walls of the groove relative to the surface of the outer layer can be, for example, 95, 100, 120, 135, or 150 degrees, or other angles. This would apply also to the openings adjacent the groove (discussed below).

Figure 14:
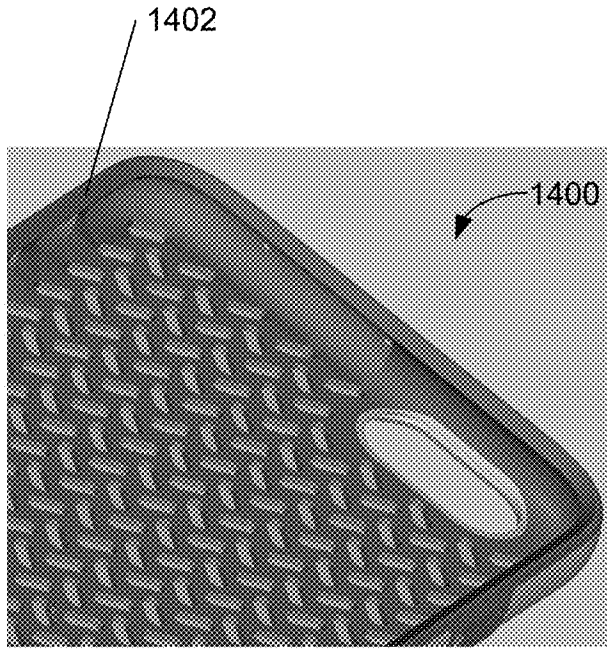
FIG. 14 shows an implementation of a case that includes a projecting edge connected to at least a portion of a sidewall.

Projecting Edge. FIG. 14 shows an implementation of a case 1400 that includes a projecting edge 1402 connected to at least a portion of a sidewall. The projecting edge extends from an outer edge 1502 of the fourth sidewall towards an interior space 1504 of the case. The interior space is defined by the base, and first, second, third, and fourth sidewalls. The electronic device is placed into the interior space of the case. The projecting edge helps hold the electronic device to the case and prevents the electronic device from slipping out. The projecting edge may also be connected to the first, second, third sidewalls, or any combination of these.

Figure 15:
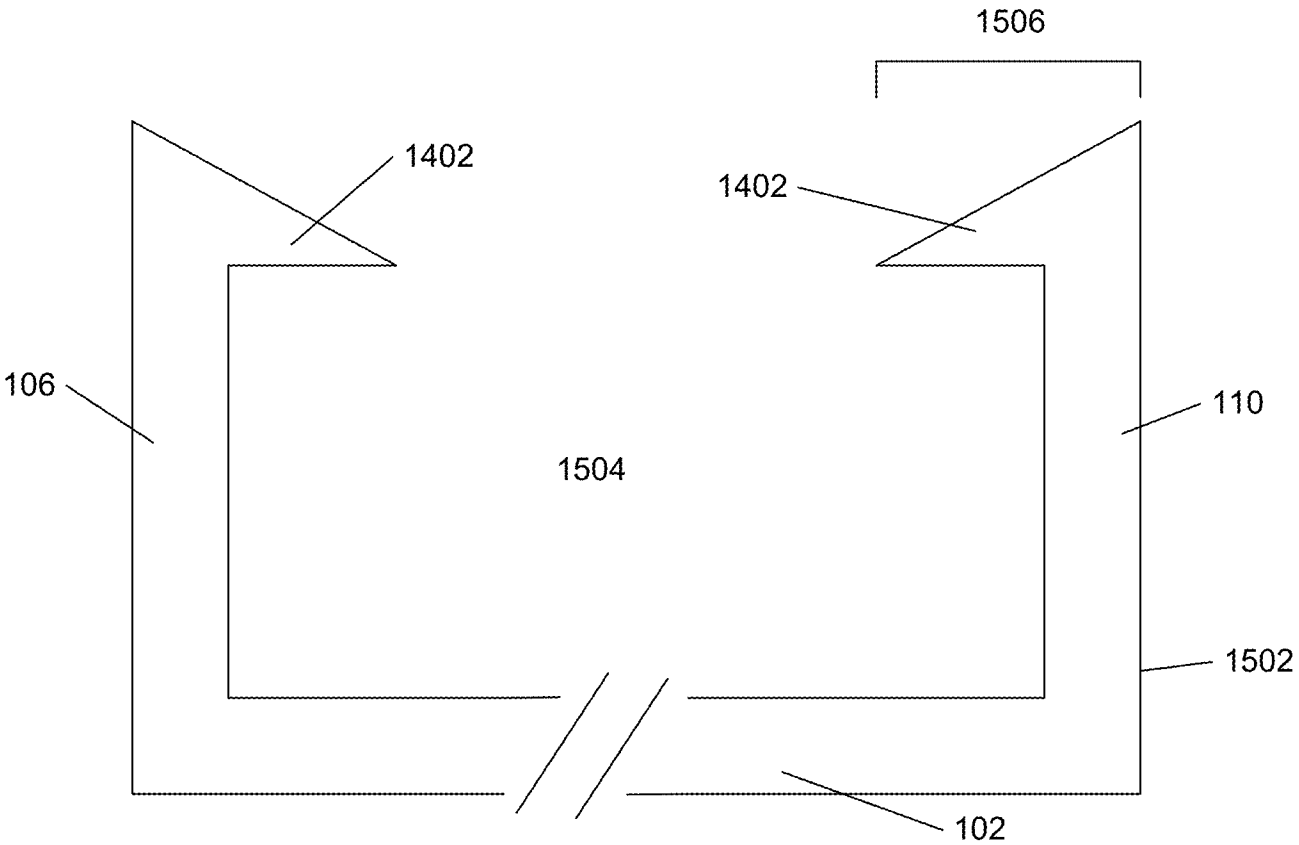
FIG. 15 shows a cross-sectional view of the projecting edge.

FIG. 15 shows a cross-sectional view of the projecting edge. The projecting edge extends a distance 1506 from the outer edge into the interior space. The two parallel diagonal lines show that a length of the base layer from sidewall 106 to sidewall 110 can be longer. The length of the base layer has been shortened in order to highlight other features. In a specific implementation, the distance is 1 millimeters. In other implementations, the distance can be greater, such as 1.5, 2, 2.5, 3, or 4 millimeters. Greater distances allows the case to have a more secure hold onto the electronic device. In other implementations, the distance can be smaller, such as 0.1, 0.3, 0.5, or 0.7 millimeters. Smaller distances allows the user to have access to a greater area of the screen of the electronic device.

FIG. 15 shows sidewalls 106 and 110 as straight walls on the inner and outer layer. In other implementations, the inner layer of sidewalls 106 and 110 are curved to hug against the curves of the electronic device. The outer layer can also be curved. The inner or outer, or both, layers of sidewalls 104 and 108 can also be curved to fit close to the curves of the device.

Figure 16:
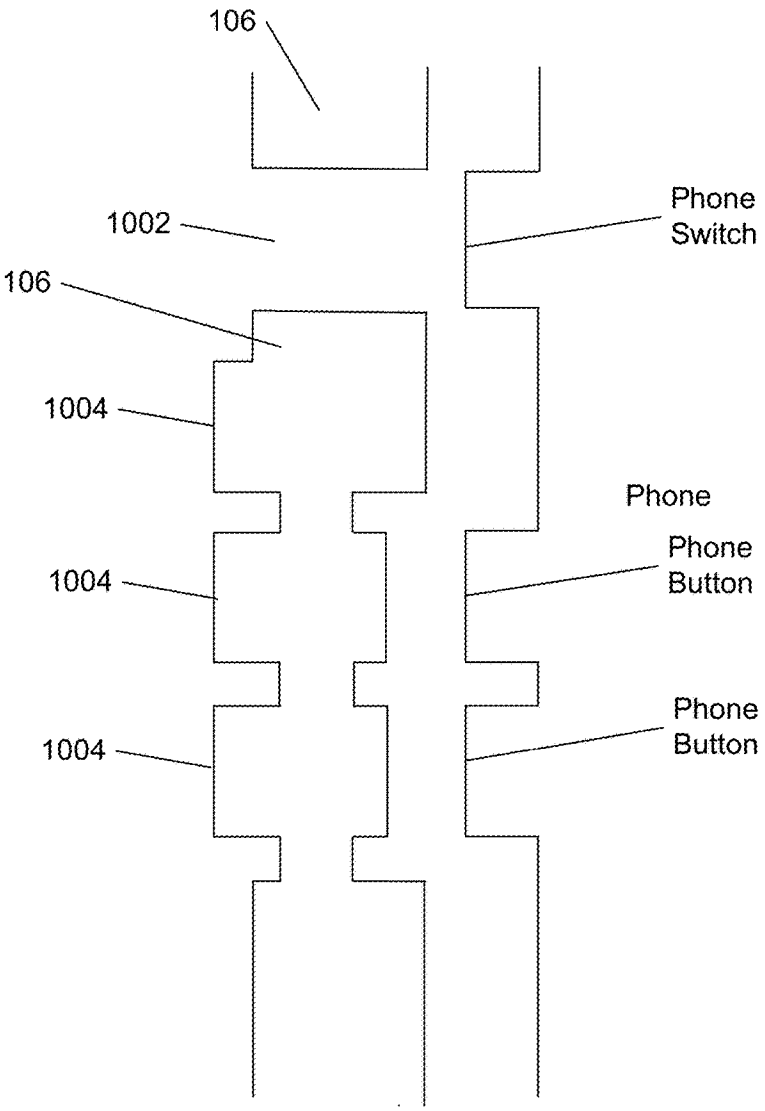
FIG. 16 shows a cross-sectional view of a portion of the second sidewall that includes protrusions and holes lined up next to a portable electronic device's buttons and features.
Figure 17:
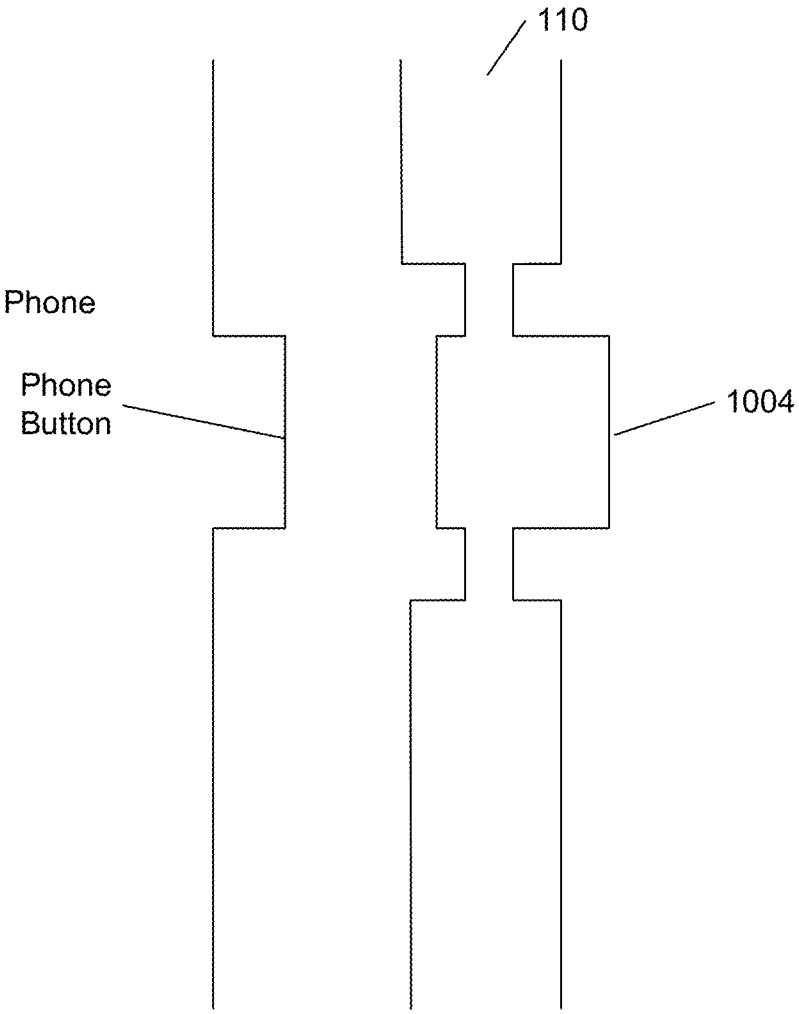
FIG. 17 shows a cross-sectional view of a portion of the fourth sidewall that includes a protrusion lined up next to a portable electronic device's button.
Figure 18:
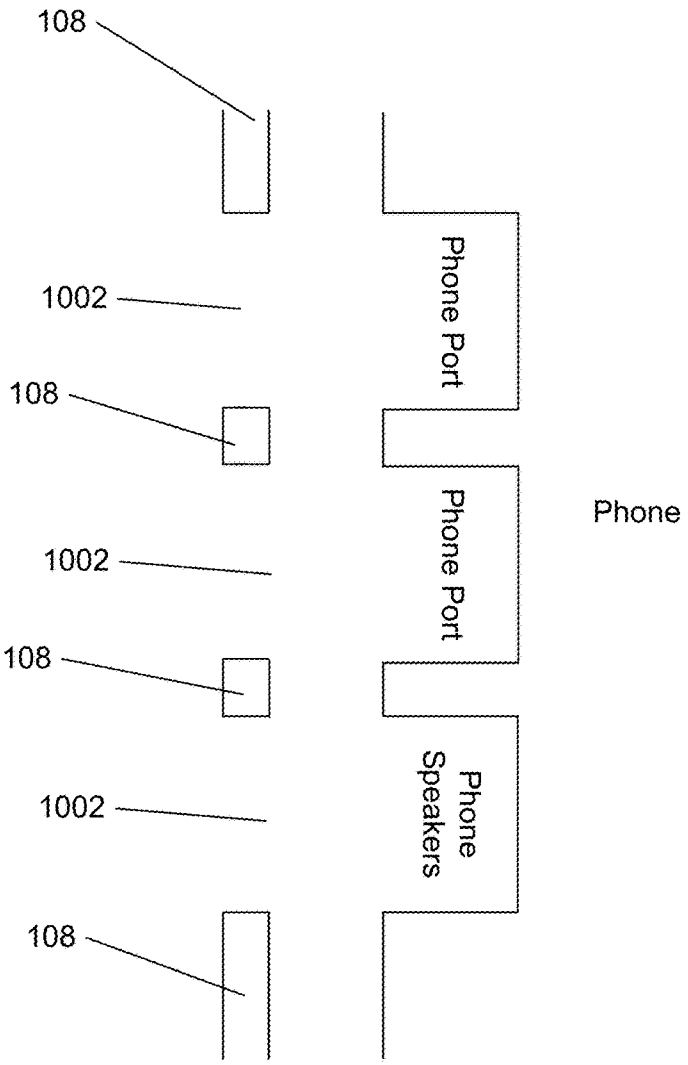
FIG. 18 shows a cross-sectional view of a portion of the third sidewall that includes holes that allows access to a portable electronic device's ports.

FIG. 16 shows a cross-sectional view (with a cutting plane 16-16 labeled in FIG. 5) of a portion of the second sidewall that includes protrusions and holes lined up next to a smartphone's buttons and features. An interior surface of the protrusion (e.g., a portion that lines up along the phone button) is recessed relative to a portion of the surrounding interior surfaces of the sidewall, which contact the perimeter of the phone (when the phone is placed inside the case) and does not include protruding buttons or switches. The recessed area prevents the protrusions of the case from pressing on the phone buttons too hard. With the recessed area, a light touch on an exterior surface of the protrusion would not cause the button to be pressed and activated. FIG. 17 shows a cross-sectional view (with a cutting plane 17-17 labeled in FIG. 5) of a portion of the fourth sidewall that includes a protrusion lined up next to a smartphone's button. FIG. 17 also includes a recessed area that lines up along the phone button when the phone is placed inside the case. FIG. 18 shows a cross-sectional view (with a cutting plane 18-18 labeled in FIG. 3) of a portion of the third sidewall that includes holes that allows access to a smartphone's ports or other features without having to take the smartphone out of the case.

Figure 19:
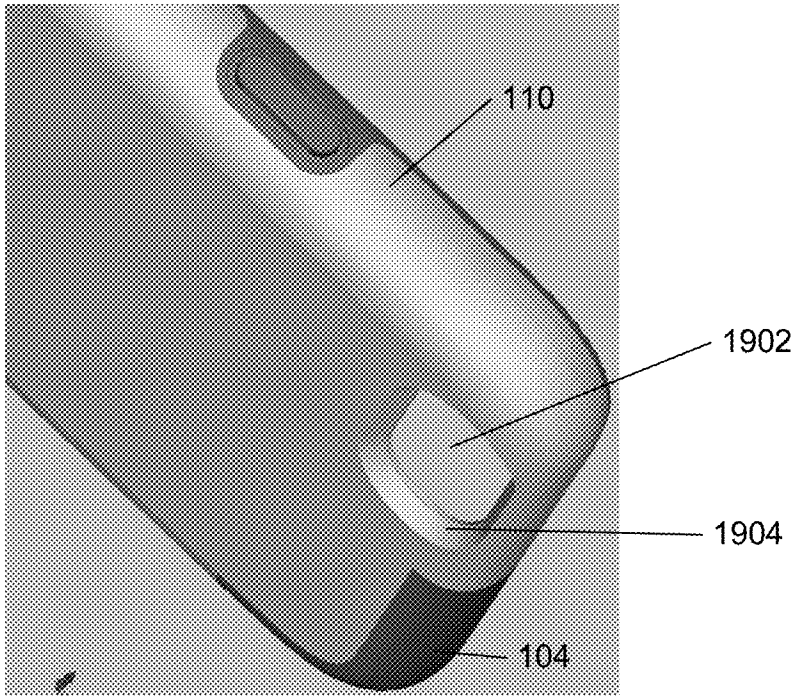
FIG. 19 shows an implementation of a case with a camera opening.

Camera Ring. FIG. 19 shows an implementation of a case with a camera opening. A feature of the smartphone or electronic device is a camera with flash. The base of the case may include a single opening 1902 for both the camera lens and flash of the phone. When using the flash to take a picture or video, glare may be introduced to the picture or video as a result of light bouncing off a white or glossy surface. To reduce the flash, the base may include a dark colored or black camera ring (e.g., camera ring insert in figure A12) connected to the camera opening. Further details of the camera ring are described in U.S. patent application Ser. No. 13/185,200, filed Jul. 18, 2011, which is incorporated by reference. In an implementation, the camera ring is made of polycarbonate. The camera ring is attached to the base of the case mechanically (e.g., via fasteners, rivets, snap fits) or through adhesion.

Colors. The case can have different colors and color schemes. The first layer can have a first color. The second layer can have a second color. The projecting edge can have a third color. The channel can have a fourth color. The holes and protrusions of the case that are adjacent to controls and ports of the electronic device can have a fifth color. Some of the colors (the first, second, third, fourth, and fifth colors) might be the same as another color. All of the five colors can be the same color. Or all of the five colors can be different colors. In a specific implementation, the projecting edge, holes and protrusions, and the channel have the same color, which for example may be light blue, gray, silver, or pink. In another specific implementation, the first and second layers can have different colors. The inner layer can have a darker color than the outer layer so that darker color of the inner layer (and if present, a pattern of the inner layer) is visible through the other layer. For example, the inner layer can be black and the outer layer can be a translucent gray. In another implementation, the inner layer can have a lighter color than the outer layer. For example, the inner layer can be black and the outer layer can be gray. In other implementation, the inner and outer layers can be pink. Or the inner and outer layers can be blue.

The dimensions of the case may vary to accommodate different sizes and dimensions of the electronic devices being housed. Table A below lists some examples of approximate dimensions of phones that can be housed in the case.

TABLE A

| Product | Product Dimensions (mm) |
|---|---|
| Apple iPhone 7 Plus | 158.2 × 77.9 × 7.3 |
| Apple iPhone 7 | 138.3 × 67.1 × 7.1 |
| Apple iPhone 6s Plus | 158.2 × 77.9 × 7.3 |
| Apple iPhone 6s | 138.3 × 67.1 × 7.1 |
| Apple iPhone 6 Plus | 158.1 × 77.8 × 7.1 |
| Apple iPhone 6 | 138.1 × 67.0 × 6.9 |
| Apple iPhone 5s | 123.8 × 58.6 × 7.6 |

Figure 20:
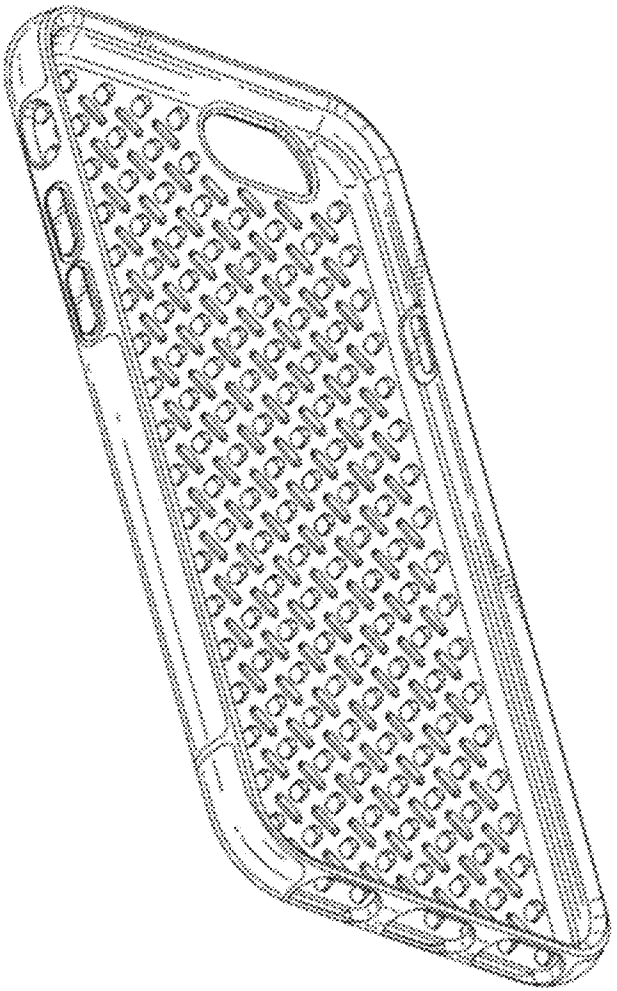
FIG. 20 shows a perspective view of an implementation of the case.

The sidewalls may be higher than a depth of the electronic device. When the user places the electronic device encased in the case facedown on a table (such that the screen faces the surface of the table), the additional height of the sidewalls lifts the screen off the surface, preventing the screen from being scratched or dirtied. Alternatively, the sidewalls can have a raised bezel around the perimeter. FIG. 20 shows a perspective view of an implementation of the case.

The Apple iPhone 7 features a design similar to the iPhone 6S and iPhone 6, though there are a few changes. The headphone jack in iPhone 6 and 6S has been removed in the iPhone 7. Instead, wired earphones connect to iPhone 7 at a lightning port. To be consistent with the features of iPhone 7, openings of the case can be adjusted in number, size, and positioning. For example, a case for iPhone 6 has an opening corresponding to the headphone jack in iPhone 6. But a case for iPhone 7 does not have an opening corresponding to a headphone jack because iPhone 7 does not have a headphone jack.

This patent application describes aspects of the invention with respect to the iPhone 6, iPhone 6 Plus, iPhone 6s, iPhone 6s Plus, iPhone 7, and iPhone 7 Plus. However, the principles of the invention are not limited to the above listed iPhone 6 and iPhone 7 series, but are applicable to any portable electronic device or smartphone or other telephony device. Some examples of other devices that the invention will be applicable to include cameras, video cameras, webcams, media players including MP3 and video players, personal digital assistants (PDAs) such as the iPAQ line of products from Hewlett Packard (www.hp.com), handheld computers, Blackberry smartphones (from Research in Motion Limited, na.blackberry.com), Samsung smartphones (www.samsung.com), Motorola phones (www.motorola-.com), HTC smartphones (www.htc.com), phones running the Android platform or operating system from Google (www.google.com, www.android.com), Nokia phones (www.nokiausa.com), and laptop and notebook computers.

Figure 21:
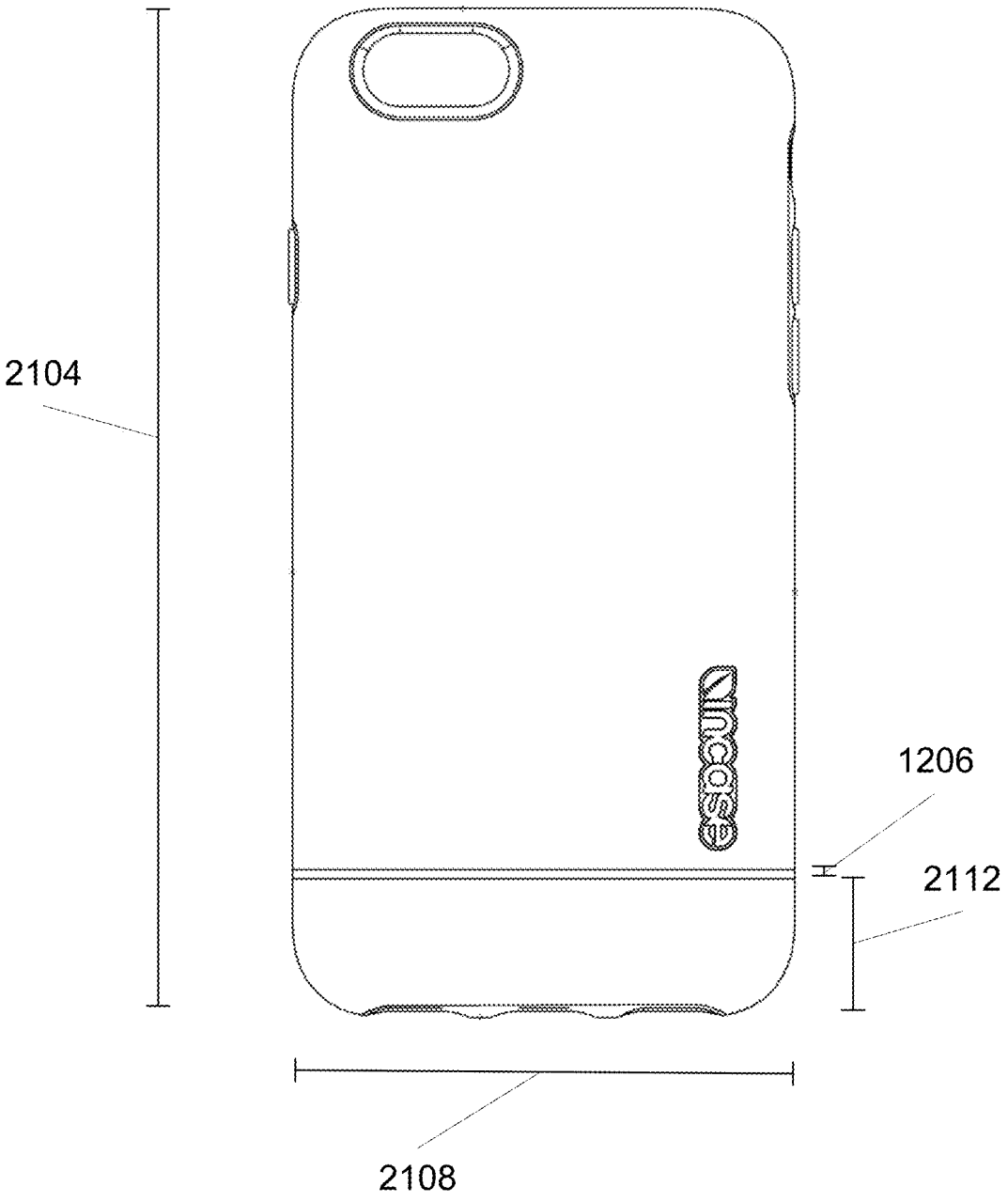
FIG. 21 shows an implementation of a case.
Figure 22:
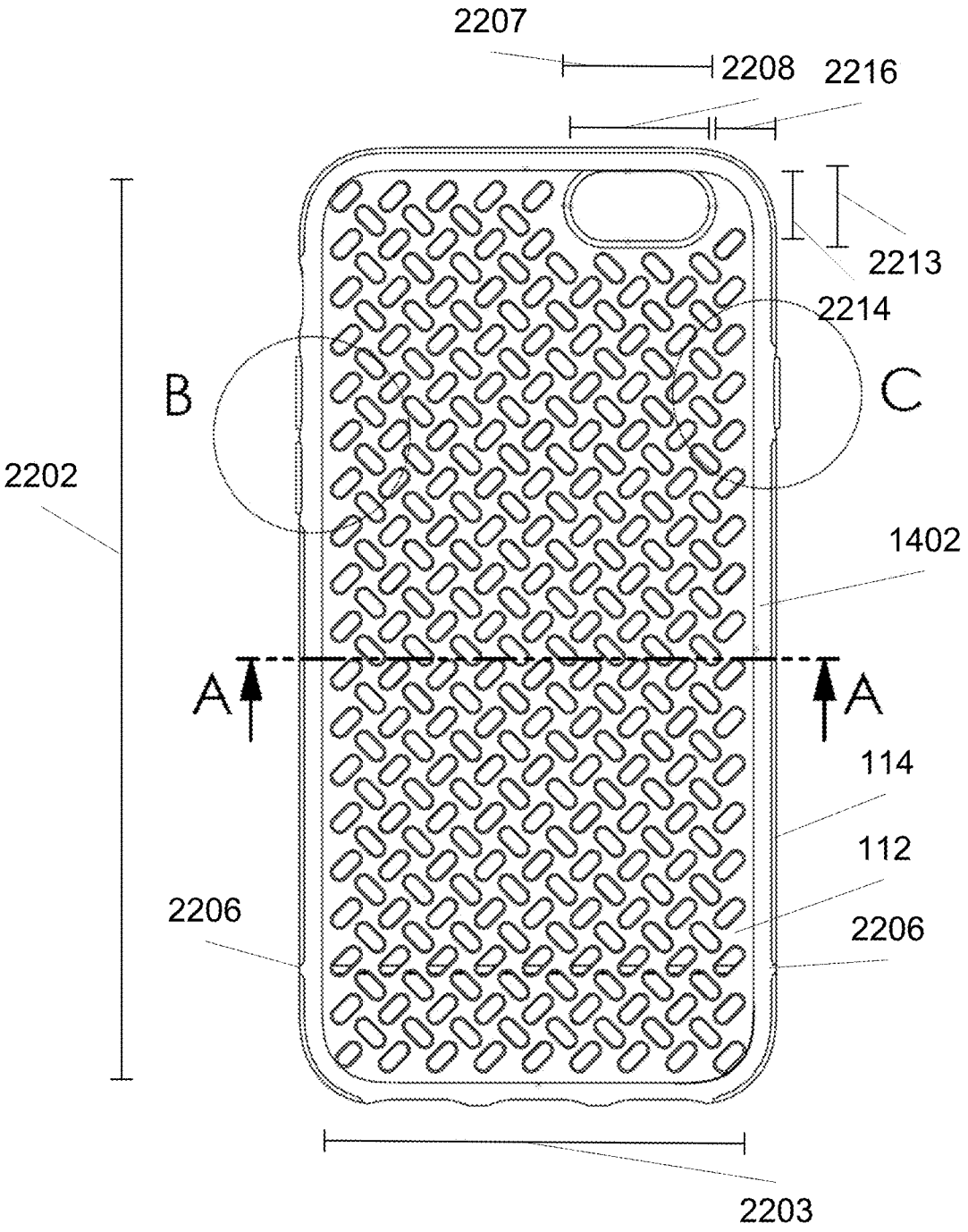
FIG. 22 shows a front view of the case.
Figure 23:
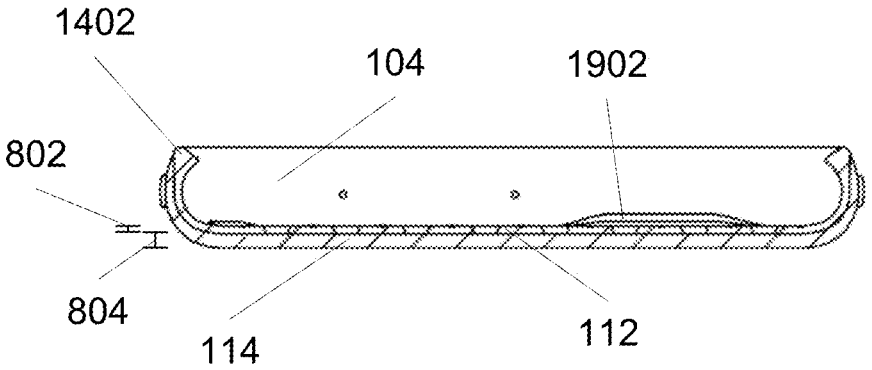
FIG. 23 shows a cross-sectional view A-A of the case in FIG. 22.
Figure 24:
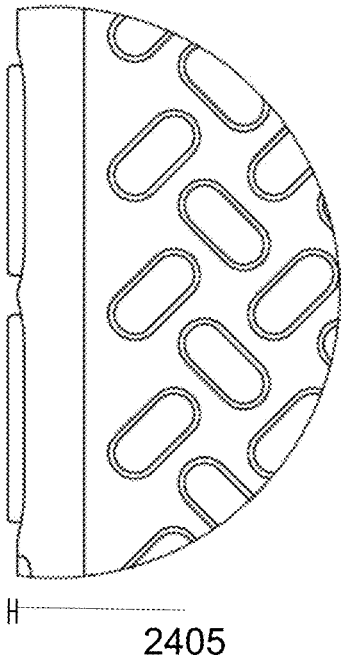
FIG. 24 shows an enlarged fragmentary view of buttons on the left sidewall of the case.
Figure 25:
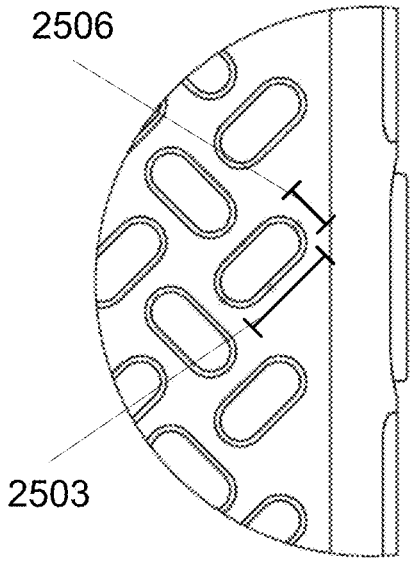
FIG. 25 shows an enlarged fragmentary view of the buttons on the right sidewall of the case.
Figure 26:
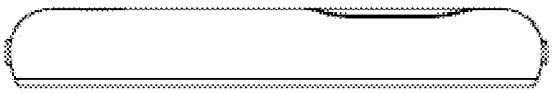
FIG. 26 shows a top view of the case.
Figure 27:
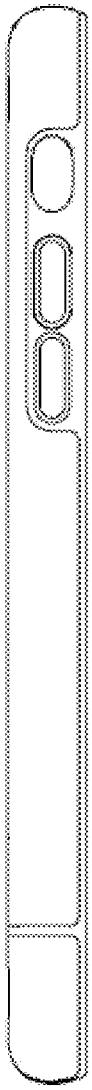
FIG. 27 shows a left side view of the case.
Figure 28:
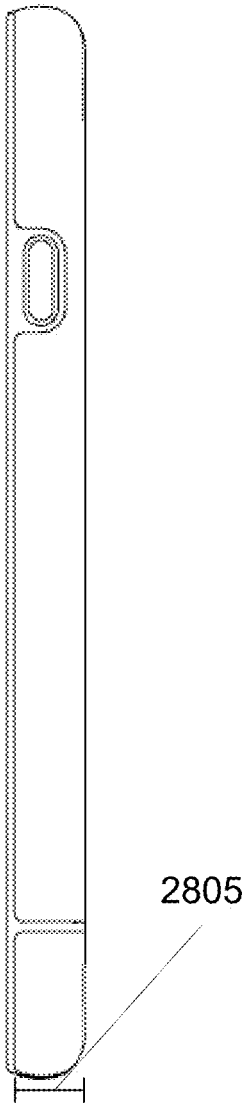
FIG. 28 shows a right side view of the case.
Figure 29:
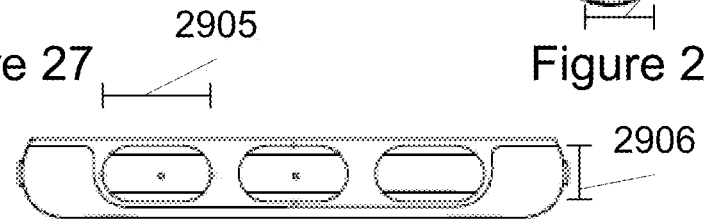
FIG. 29 shows a bottom view of the case.

FIGS. 21-29 show an implementation of a case for an iPhone 6S. FIG. 21 shows a back view of the case. FIG. 22 shows a front view of the case. FIG. 23 shows a cross-sectional view A-A of the case in FIG. 22. FIG. 24 shows an enlarged fragmentary view of buttons on the left sidewall of the case. FIG. 25 shows an enlarged fragmentary view of the buttons on the right sidewall of the case. FIG. 26 shows a top view of the case. FIG. 27 shows a left side view of the case. FIG. 28 shows a right side view of the case. FIG. 29 shows a bottom view of the case.

FIG. 21 shows an implementation of a case that is generally rectangular with top, bottom, left, and right sidewalls. The top sidewall is joined to the left and right sidewalls with rounded corners. The bottom sidewall is joined to the left and right sidewalls with rounded corners. The case has a length 2104 extending from the top sidewall to the bottom sidewall and a width 2108 extending from left sidewall to right sidewall. The channel of the case has a thickness 1206 of 1.3 millimeters.

The channel is positioned at a distance 2112 from the bottom sidewall. In the implementation shown, the channel is about 0.65 millimeters from the bottom sidewall. The position of the channel at this distance from the bottom sidewall allows the user to flex the case at that position and insert the electronic device into the case easily. It is more difficult to flex areas of the case that is closer to the perimeter of the case, or closer to the sidewalls of the case. When inserting an electronic device into the case, the user typically inserts one end of the electronic device into the case first and then the second, or opposite, end. Being able to flex one end of the case (or a sidewall) in order to wrap the case around the second end makes the insertion process easier and less frustrating. Therefore, a channel close to a sidewall (e.g., the bottom sidewall) of the case makes the insertion process easier. A ratio of distance 2112 to length 2104 of the case is 19.65/141.64 or 0.139. The ratio can be smaller, such as 0.13, 0.12, 0.11, 0.10, 0.09, or smaller. A smaller ratio signifies less flexibility at the position of the channel, which may be more desirable because the electronic device is held more securely within the case. The ratio can be larger, such as 0.14, 0.15, 0.16, 0.18, 0.20, 0.3, 0.35, 0.4, 0.45, or larger. A larger ratio places the channel farther from a sidewall, which would increase flexibility of the case at the channel. The increased flexibility may be desirable because the electronic device can be inserted more easily into the case. A ratio of 0.5 would place the channel at the position midway between top and bottom sidewalls of the case, which has a large amount of flexibility.

FIG. 22 shows a front view of case. The front view shows the inner layer 112 of the base and the first, second, third, and fourth sidewalls that is joined to the base. The portions of the sidewalls visible in this front view are the outer layer 114 of the sidewalls and the projecting edge 1402. The inner layer of the sidewalls is underneath projecting edge 1402 and cannot be seen in this view. Projecting edge 1402 is connected to the sidewalls and extends into the interior space 1504 of the case. When an electronic device is placed inside the case, the projecting edge overlaps the edges of the electronic device and holds the electronic device in place.

A distance that the projecting edge extends into the interior space of the case is 3.045 millimeters. The distance can be more, such as 4, 5, 6, or more, so that the electronic device can be clasped more securely to the case. The distance can also be less, such as 3, 2, 1, or 0.5 so that the screen of the electronic device is less obstructed by the projecting edge.

For this implementation of the case, the projecting edge is made of the same material as the inner layer. In other implementations, the projection edge can be made of the same material as the outer layer or have dual layers, similar to the base of the case.

At the channel, the case has one layer of material, instead of two layers. FIG. 22 shows that the outer edges 2206 of the case where the channel is located does not have the same material as outer layer 114. The channel is made of the inner layer material and the inner layer material extends all the way through to the outer layer and lies flush with the outer layer material. In other implementations, a surface of the inner layer is below the surface of the outer layer. In another implementation, one or more portions of the surface of the inner layer is above the surface of the outer layer.

Other portions of the case are made of one layer of material, instead of two layers, including the buttons and holes.

FIG. 23 shows a cross section of the case facing towards the top sidewall. The outer layer material is present in the base and the sidewalls. The inner layer material is present in the base, sidewalls and projecting edge 1402. The projecting edge has a negative slope as it extends from the outer edges of the case towards the interior of the case. The negative slope gives the effect of opening up the screen to the user so the user does not feel the screen is obstructed by the projecting edge. In other implementations, the slope can be positive. With a positive slope, the projecting edge becomes towards the interior of the case. A thicker projecting edge allows the user to have a better grip on the projecting edge in order to flex and peel the case off of the electronic device.

FIG. 24 shows an enlarged fragmentary view of the buttons on the left sidewall. FIG. 25 shows an enlarged fragmentary view of the buttons on the right sidewall. FIG. 25 also shows the obround patterns with length 2503 and width 2506. In other implementations, the pattern can be made with circles, ellipses, ovals, squares, triangles, or other geometric or arbitrary shapes or polygons.

FIG. 26 shows a top view of the case. FIG. 27 shows a left side view of the case. FIG. 28 shows a right side view of the case. FIG. 29 shows a bottom view of the case.

Figure 30:
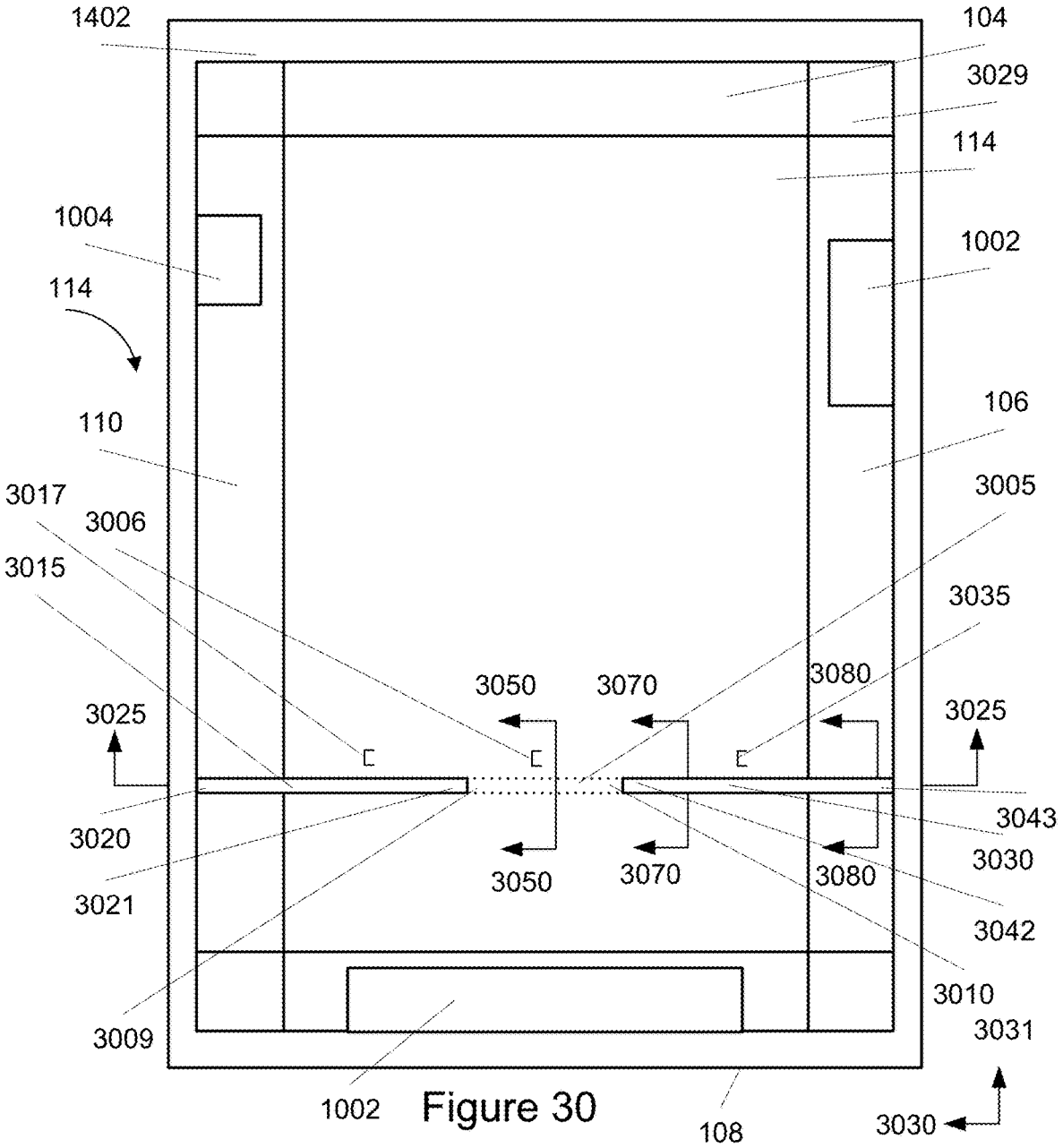
FIG. 30 shows a block diagram of a back view of the case.

FIG. 30 shows a block diagram of a back view of the case. In this view, the top, left, bottom, and right sidewalls have been flattened and spread out to be in the same plane as the base. Because this is a back view, the material of the base and sidewalls visible to the eye is the outer layer 114, which may be referred to as the polycarbonate (PC). There are cutouts in the outer layer of the right, bottom, and left sidewalls. In an implementation, the cutouts are filled with the same material (not shown in FIG. 30) of the inner layer (e.g., thermoplastic polyurethane or TPU) and form protrusions 1004, and holes 1002; the inner layer cannot be seen from this view. Projecting edge 1402 has also been flattened and spread out. In an implementation, the cutouts are filled with a different material than the inner layer, but having greater elasticity than the outer layer (e.g., polycarbonate).

Although one groove or channel are shown in FIG. 30, an implementation can have multiple grooves, such as 2, 3, 4, 5 or more grooves. Typically, the greater the number of grooves, the greater the flexibility of the case. So for larger or more elongated devices, such as a tablet computer, the case may include two or more grooves. The construction will be similar to that described for a single groove. The grooves are oriented to run transverse to the longer sides of the case. However, in some implementations, the grooves are oriented to run parallel to the longer sides of the case. And in some implementations, the grooves extend in multiple orientations and can crisscross.

The case includes a groove 3005 (shown in broken lines) formed in the outer layer in the back portion, where the groove extends from the exterior surface of the outer layer toward the interior surface of the outer layer a first depth at a groove bottom surface, where the first depth is less than a thickness of the outer layer from the exterior surface to the interior surface, and the groove has a first width 3006, the groove extends from a first end 3009 to a second end 3010, and first end is opposite to the second end.

The case can include a first opening 3015, formed in the outer layer in the back portion, where a second width 3017 of the first opening is the same as the first width, a second depth (shown in FIG. 31 as depth 3105) of the first opening extends from the exterior surface of the outer layer to the interior surface, the first opening comprises a third end 3020 and a fourth end 3021, and the third end is connected to the first end of the groove. In other implementations, the first width is larger than the second width or smaller than the second width.

In an implementation, the fourth end of the first opening is positioned in the right sidewall. In other implementations, the fourth end can be positioned in the left, top, or bottom sidewalls. Or the fourth end can be positioned within the base portion of the case. In other implementations, the fourth end can be positioned at a corner 3029 of the case.

The case can also include a second opening 3030, formed in the outer layer in the back portion, where a third width 3035 of the second opening is the same as first width, a second depth 3134 of the second opening extends from the surface of the outer layer to the interior surface, the third opening comprises a fifth end 3042 and a sixth end 3043, and the fifth end is connected to the second end of the groove. In other implementations, the third width can be larger or smaller than the first width, or larger or smaller than the second width. The second depth of the second opening can be larger or smaller than the first depth.

Opening 3015, opening 3030, and groove 3005 are arranged in a line. The material filling in the openings and deposited in the groove will appear as a line across the back of the case. The material may be referred to as an insert or filler, and may be made of a TPU or other polymer that has more flexibility or elasticity than the material of the outer layer. The filler or insert material can be the as the inner layer material, or can be different. The insert or filler material can have an upper surface that is flush with the surface of the outer layer. In other implementations, the upper surface can be below or above the surface of the outer layer. The upper surface can be tacky (or tackier) to give more grip than the surface of the outer layer.

FIG. 30 shows a groove positioned between two openings. In other implementations, the groove can extend fully across the back and sides, and there are not openings. The groove can be omitted, and the openings merge into a single opening that extends across the back and sides. There can be one opening, to one side of the groove. There may be multiple grooves, with an opening between each groove. In an implementation, the openings on either side of the groove are the same width. The openings on either side of the groove can have a different width. The width of the groove is less than a sum of widths of the two openings. In implementation, a midpoint of the groove is positioned midway between the two sidewalls of the case. But in other implementations, the groove is positioned at a position between the two sidewalls of the case, but not midway between the sidewalls (e.g., at a position 10 percent, 25 percent, 30 percent, or 40 percent between the sidewalls).

A gap between sidewalls of opening 3015 is a first distance. A gap between sidewalls of groove 3005 is a second distance. A gap between sidewalls of opening 3030 of the opening is a third distance. In an implementation, the first distance, second distance, and third distance are the same, and the line going across the back and sides will have a uniform thickness. In an implementation, these distances are different or vary. For example, the first distance can be the same as the third distance, but different from the second distance, where the first distance is greater than the second distance. The first distance can be the same as the third distance, but different from the second distance, where the first distance is less than the second distance. Each of the first, second, and third distances can be different. The first is greater than the second which is greater than the third. The first is greater than the third which is greater than the second. The second is greater than the first which is greater than the second.

FIG. 30 shows an implementation where there are no openings or cutouts in the corner, which will be filled with the elastic insert or filler material (e.g., TPU). The flex allowed by the flex groove is sufficient to allow insertion of a device into the case without openings or cutouts in the corners. In further implementations, holes or cutouts 1004 and 1002 are also omitted, and one or more flex grooves will allow sufficient flex.

Figure 31:
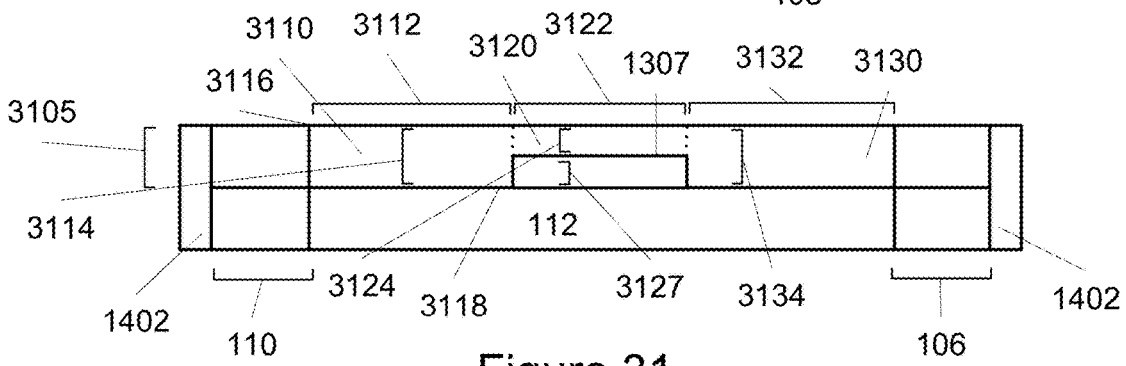
FIG. 31 shows an enlarged view of an implementation of a cross section of the case in FIG. 30.

FIG. 31 shows an enlarged view of an implementation of a cross section 3025-3025 of the case in FIG. 30. The cross-sectional view is along a first direction 3030, which extends between the left and right sidewalls.

The case can include a first portion 3110 of an insert 3111 made of a flexible material (e.g., TPU or any material that the inner layer can be made of), formed in the first opening. The insert may be referred to as the TPU. The first portion of the insert comprises a fourth width 3112 that is the same as the second width, and a thickness 3114 extending from at least the exterior surface of the outer layer 3116 to the interior surface 3118.

The case can also include a second portion 3120 of a insert, formed in the groove. The second portion of the insert comprises a fifth 3122 width that is the same as the first width, and a thickness 3124 extending from at least the exterior surface of the outer layer to the groove bottom surface. In a specific implementation, the groove bottom surface is partially between the exterior and interior surface of the outer layer, and so the groove is partially through the outer layer. And a remaining distance 3127 between the groove bottom surface and the interior surface of the outer layer is a polycarbonate material. In another implementation, the groove extends all the way through the outer layer, so the groove bottom surface is at the interior surface of the outer layer.

The case can also include a third portion 3130 of a insert, formed in the second opening, the third portion of the insert comprises a sixth width 3132 that is the same as the third width, and a thickness 3134 extending from at least the exterior surface of the outer layer to the interior surface.

Material for the first 3110, second, and third portions can be the same or be different with varying degrees of softness or flexibility. The material for the first, second, or third portions can be the same as the material for the inner layer, different from the material for the inner layer, or a composite of both.

In an implementation, the insert can be flush with the exterior surface of the outer layer. In other implementations, the insert can be uneven relative to the exterior surface of the outer layer. Further, the thicknesses of the insert for the first, second, or third portions can be the same, or different from each other. For example, all first, second, and third portions can all be flush with the exterior surface. Or the first and third are flush, but the second is not.

In an alternative implementation, instead of a flexible material filling or partially filling the first opening, groove, or second opening, there can be no material at all. Filling or partially filling the first opening, groove, or second opening can help prevent dust or dirt from accumulating there.

However, not filling the openings and grooves decreases the amount of materials used to produce the case.

Figure 32A:
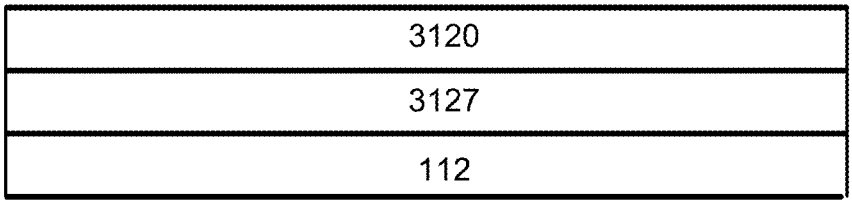
FIG. 32A shows cross-sectional view of a groove for an implementation of the case.
Figure 32B:
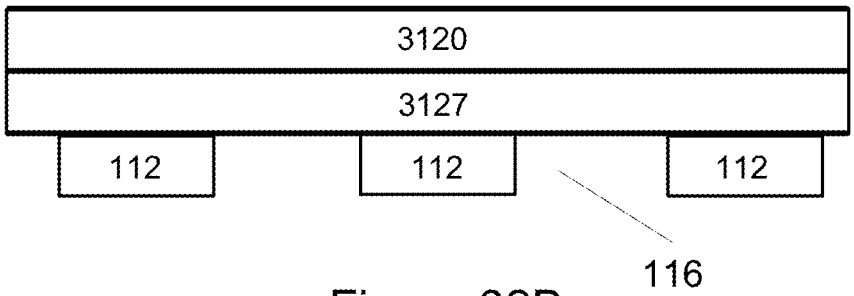
FIG. 32B shows cross-sectional view of the groove for an implementation of the case including openings in the inner layer.

FIG. 32A shows cross-sectional view 3050-3050 of an implementation of the groove in a second direction 3031, which is transverse to the first direction 3030, at a first distance from the left side wall. A top layer is made of inner layer material. Underneath is the middle portion, made of outer layer material. And underneath is the inner layer. In this implementation, the inner layer does not have openings or perforations. However, in FIG. 32B, the inner layer includes openings 116.

Figure 33A:
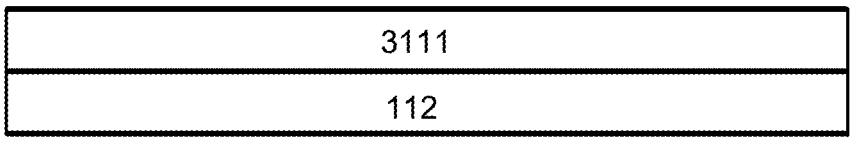
FIG. 33A shows cross-sectional view of the second opening for an implementation of the case.
Figure 33B:
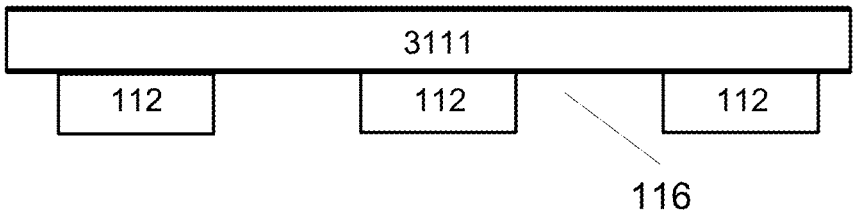
FIG. 33B shows cross-sectional view of the second opening for an implementation of the case including openings in the inner layer.

FIG. 33A shows cross-sectional view 3070-3070 of an implementation of the second opening in the exterior layer in a second direction 3031, which is transverse to the first direction 3030, at a second distance from the left sidewall. The second distance is closer to the left sidewall than the first distance and cross-sectional view is taken across section 3003. A cross-sectional view across section 3004 should be similar. A top layer is made of inner layer material. And underneath is the inner layer. In this implementation, the inner layer does not have openings or perforations. However, in FIG. 33B, the inner layer includes openings 116. Cross-sectional view 3080-3080 of the second opening in the exterior layer of sidewall 106.

Figure 34:
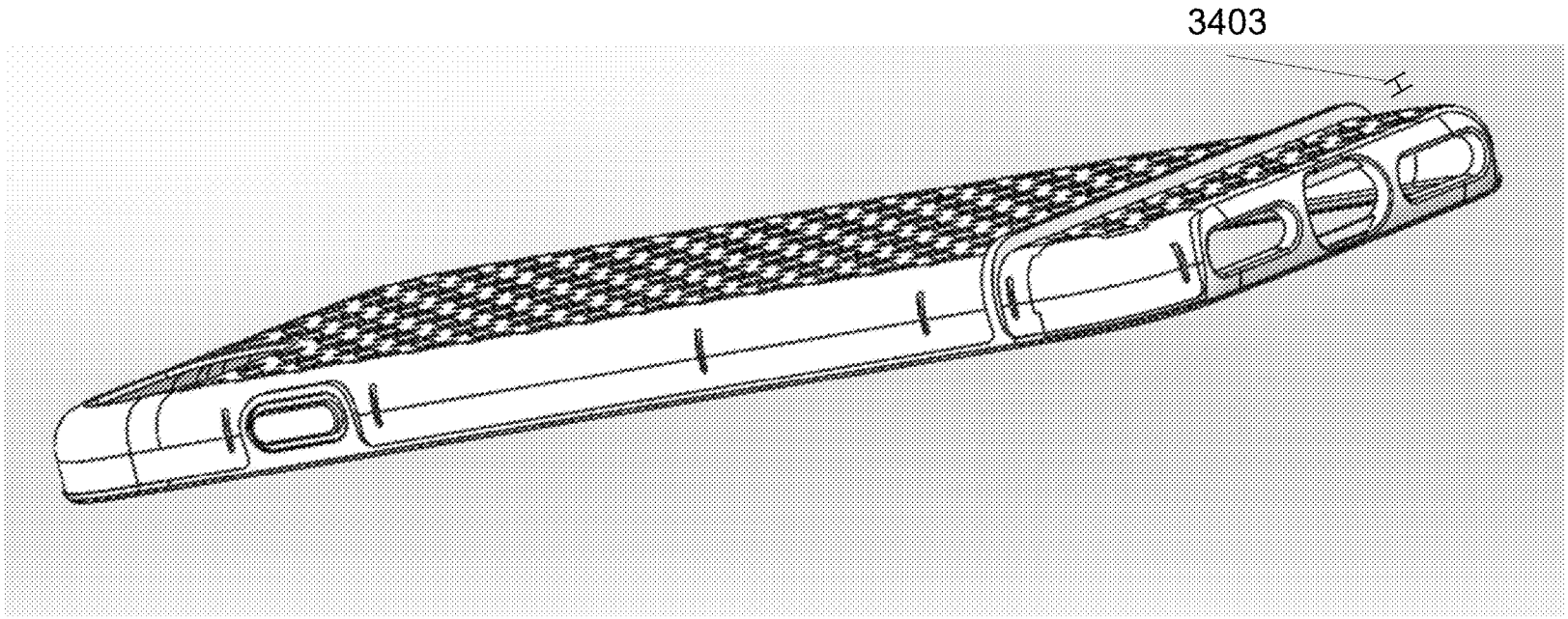
FIG. 34 shows a perspective view of an implementation of the inner layer of the case.

FIG. 34 shows a perspective view of an implementation of the inner layer of the case. The channel has a height 3403 relative to the base portion. In a specific implementation, the height is 1.5 millimeters.

Figure 35:
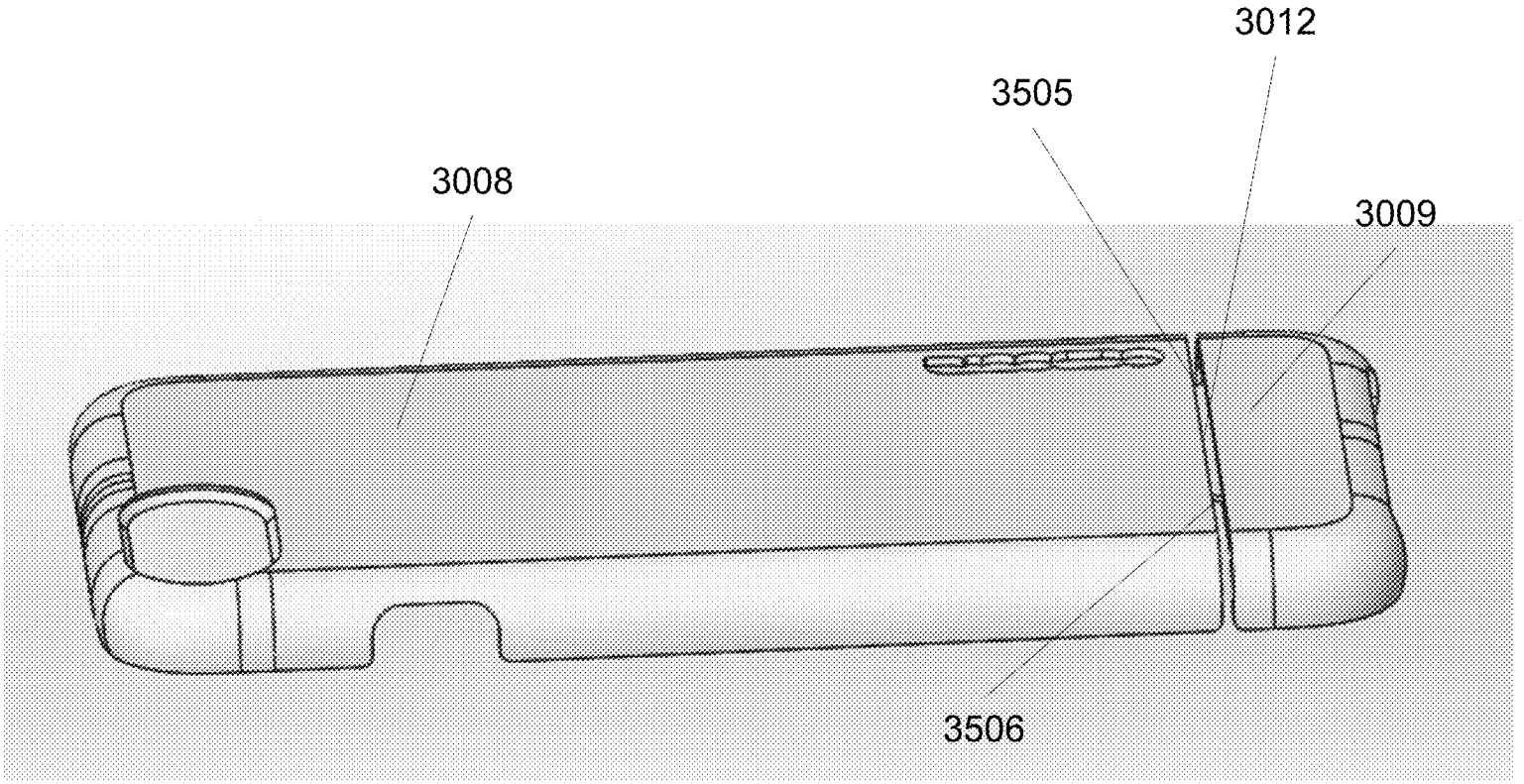
FIG. 35 shows perspective views of an implementation of the outer layer of the case.

FIG. 35 show perspective views of an implementation of the outer layer of the case. The outer layer of the case is divided into two portions, upper 3008 and lower 3009 portions. The upper portion is connected to the lower portion by middle portion 3012. Middle portion extends from a first distance 3505 from the left sidewall to a second distance 3506 from the left sidewall. In a specific implementation, the middle portion has a thickness of 0.57 millimeters, which is thinner than the upper and lower portions of the outer layer with thicknesses of about 1.5 millimeters to about 1.63 millimeters.

Figure 36:
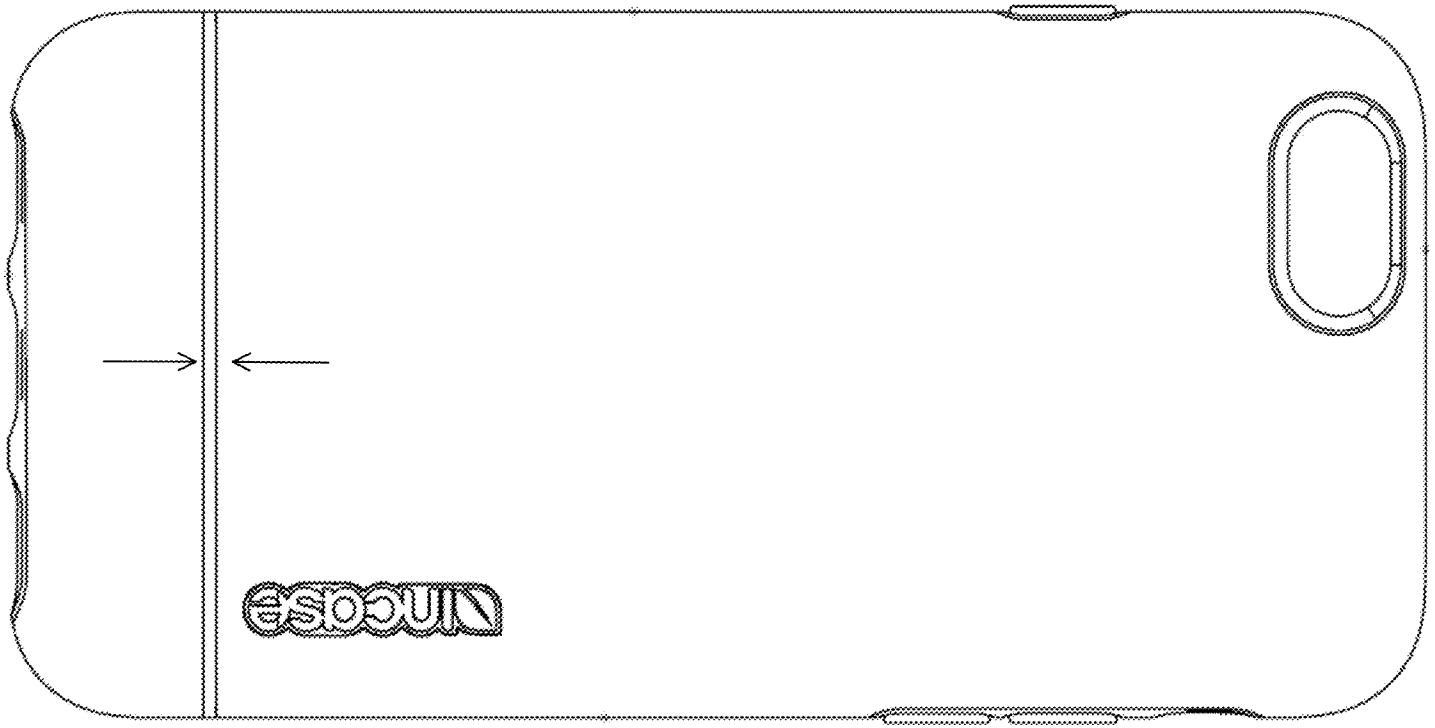
FIG. 36 shows a direction of movement of the channel (or groove) when a user flexes the case to insert the portable electronic device.

FIG. 36 shows a direction of movement of the channel (or groove) when a user flexes the case to insert the phone. Typically, a user inserts the phone into the case so an end (e.g., upper or bottom shorter edges) is inserted into the case first, while flexing the case. This slightly enlarges the front opening of the case to allow the phone to fit in. The flex groove or channel on the back and sides of the case allows the flexing. Specifically, in the back, the walls of the openings and groove are pushed toward each other, compressing the material in the openings and groove. When the flexing is stopped, the sidewalls return to their original positions and the material, due to its elastic property, returns to its original shape.

The dimensions of the case can be adjusted to fit various dimensions and sizes of different electronic devices. The electronic devices might also have different features. For example, there might be one less hole in a sidewall in the case because a button was no longer in the design for an electronic device. The invention is not limited to the dimensions shown in these implementations of the case. The dimensions can be smaller or larger depending on the electronic device.

This application describes some examples of implementations with specific dimensions, measurements, and values. These are not intended to be exhaustive or to limit the invention to the precise form described. The dimensions or measurements are in millimeters (or inches), radii of curvature in millimeters, angles in degrees. The values are approximate values. These values can vary due to, for example, measurement or manufacturing variations or tolerances or other factors. For example, depending on the tightness of the manufacturing tolerances, the values can vary plus or minus 5 percent, plus or minus 10 percent, plus or minus 15 percent, or plus or minus 20 percent.

Further, the measurements are for a specific implementation of the device, and other implementations can have different values, such as certain dimensions made larger for a larger-sized product, or smaller for a smaller-sized product. The apparatus may be made proportionally larger or smaller by adjusting relative measurements proportionally (e.g., maintaining the same or about the same ratio between different measurements). In various implementations, the values can be the same as the value given, about the same of the value given, at least or greater than the value given, or can be at most or less than the value given, or any combination of these.

Table B below shows dimensions for specific implementations in millimeters of the case. It should be understood that the invention is not limited to the specific dimensions presented. The dimensions can be adjusted to be higher or lower for different features of the electronic device that the case is intended to protect. Further, the dimensions in other implementations of the invention may not be exactly the same as the dimensions presented and may be modified or altered as appropriate for a particular application or based on the data or situation.

TABLE B

| Implementations | Implementation 1 (mm) | Implementation 2 (mm) | Implementation 3 (mm) | Implementation 4 (mm) |
|---|---|---|---|---|
| Length of case 2104 | 141.64 | 161.57 | 142.04 | 161.65 |
| Width of case 2108 | 70.47 | 81.27 | 70.87 | 81.41 |
| Length between inner borders of projecting edge 2202 | 135.39 | 154.72 | 136.07 | 155.09 |
| Width between inner borders of projecting edge 2203 | 64.38 | 74.61 | 64.42 | 74.58 |
| Length of outer borders of camera ring 2207 | 22.50 | 22.75 | 26.1 | 37.50 |

TABLE B-continued

| Implementations | Implementation 1 (mm) | Implementation 2 (mm) | Implementation 3 (mm) | Implementation 4 (mm) |
|---|---|---|---|---|
| Length of inner borders of camera ring 2208 | 20.50 | 21.75 | 24.4 | 34.67 |
| Width of outer borders of camera ring 2213 | 12.5 | 10.45 | 25.9 | 35.7 |
| Width of inner borders of camera ring 2214 | 10.30 | 9.45 | 12 | 12 |
| Distance of camera ring from right sidewall 2216 | 8.91 | 10.55 | 6.25 | 6.25 |
| Thickness of inner layer 802 | 0.86 | 0.83 | 0.86 | 0.83 |
| Thickness of outer layer 804 | 1.63 | 1.50 | 1.63 | 1.50 |
| Protruding height of buttons 2405 | 0.50 | 0.50 | 0.50 | 0.50 |
| Length of obround opening in inner layer 2503 | 5.48 | 4.83 | 4.71 | 4.71 |
| Width of obround opening in inner layer 2506 | 2.69 | 2 | 1.88 | 1.88 |
| Height of a polycarbonate portion of a sidewall 2805 | 10.22 | 10.64 | 10.79 | 10.87 |
| Length of a hole in a sidewall 2905 | 14.31 | 12.43 (a first hole) 15.72 (a second hole) 19.58 (a third hole) | 13.9 | 15.96 |
| Width of a hole in a sidewall 2906 | 7.42 | 7.41 (for all holes) | 2.6 | 3.0 |
| Width of channel 1206 | 1.3 | 1.25 | 1.3 | 1.25 |
| Distance of channel from bottom sidewall 2112 | 19.65 | 21.12 | 19.65 | 21.12 |
| Thickness of Projecting Edge | 3.045 | 3.33 | 3.225 | 3.415 |

A method of making a case for an electronic device includes forming an inner layer having a first inside surface and a first outside surface; forming an outer layer having a second inside surface and a second outside surface, where the second inside surface of the outer layer bonds with the first inside surface of the inner layer; forming openings in the inner layer; removing a portion of the outer layer and replacing the portion with a first material of the inner layer; forming a camera-flash opening in the back of the case, where the camera-flash opening extends from the inside surface through to the outside surface; and applying a dark coloring to an edging of the camera flash opening.

The inner and outer layers of the case can be processed on extrusion as well as injection, blow and compression molding equipment. They can be vacuum-formed or solution-coated. The inner layer can be processed with a different method than the outer layer, or they can both be processed with the same method.

A specific flow for making a case as described in this application is described below. However, it should be understood that the invention is not limited to the specific flows and steps presented. A flow of the invention may have additional steps (not necessarily described in this application), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application or based on the data or situation 1. Forming a first and second layer of the case through comolding (or co-injection molding or sandwich molding), which is a process used to combine a first material with a second material, where the first and second materials have different properties. More specifically, comolding can be used to combine hard plastics with soft materials. The comolding process can be performed during a single press machine cycle, allowing the case to be manufactured within a shorter amount of time.

A first material, in liquid or melted form, is injected into a mold. The first material can be injected through a sprue, or a channel through which the material is poured into the mold. A second material, also in liquid or melted form, is then injected into the mold until the mold cavity is nearly filled. The second material can also be injected through the same sprue. The first material is injected again to purge the second material from the sprue.

1. In another implementation, forming a first layer of a case. The first layer of the case may be formed in various ways, such as cutting or using overmolding or injection molding. For overmolding, a first material (e.g., liquid or uncured plastic) is injected or poured into a first mold along with a catalyst. The mold and plastic is subjected to a temperature to activate the catalyst and material. After a sufficient time for processing to occur, the mold can be opened, and the first layer removed. The first layer can be cleaned and flashing removed. The mold used in the processing can include features that will form features (e.g., camera-flash opening, protrusions, and holes) of the case described in this application.

2. Forming a second layer of the case and bonding the second layer to the first layer.

The first layer can be placed into a cavity of a second mold. The second mold is clamped (or closed) and a second material in molten form is injected into the mold cavity. Heat and pressure conditions in the second mold cause the first and second materials to partially fuse together. In an implementation, the first layer is the inner layer of the case and the second layer is the outer layer. In another implementation, the first layer is the outer layer and the second layer is the inner layer.

3. Forming openings through a first layer of the case. For example, a mold used in processing a case will have a feature that will form the openings described. The mold will have regions where plastic will be present (e.g., vessels or channels) and also regions where plastic will be absent (e.g., solid mold material that prevents plastic from curing or forming where the patterns or perforations are).

4. Forming a channel from a sidewall to an opposite sidewall of the first layer of the case. Similar to step 3, the mold used in processing the case will have a feature that forms the channel described.

The case may be made using any manufacturing technique. Some examples of manufacturing techniques that may be used to make a case include injection molding, stereolithography, selective laser sintering, fused deposition molding, polyjet, casting (e.g., cast urethane molding), CNC machining, or combinations of these.

In a specific implementation, the method includes coloring an edge of the back opening a black or other dark color, attaching a black or other dark colored grommet to the back opening, or both. The black or dark color can help to reduce the glare from the flash to the camera. This step is optional and is not included in some implementations of the case. Techniques to reduce or prevent glare to the camera from the flash are further discussed in U.S. patent application 61/365,302, filed Jul. 16, 2010, which is incorporated by reference.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

What is claimed is:

1. A case for a portable electronic device comprising:

a base portion comprising a first layer, wherein the first layer comprises an interior surface and an exterior surface:

first, second, third, fourth sidewalls coupled to the base portion, wherein the first, second, third, and fourth sidewalls are configured to surround the electronic device, and the first and third sidewalls are shorter than the second and fourth sidewalls, and wherein said second sidewall contiguously extends from said first sidewall to said third sidewall and said fourth sidewall contiguously extends from said first sidewall to said third sidewall:

a groove, formed in the first layer in the base portion and oriented to run transverse to the second and fourth sidewalls, wherein the groove extends from the exterior surface of the first layer toward the interior surface of the first layer a first depth at a groove bottom surface, and wherein the groove comprises a first width, the groove extends from a first end to a second end, and the first end is opposite to the second end;

a first opening, formed in the first layer in the base portion, wherein the first opening comprises a second width and a second depth, the second depth extends from at least the exterior surface of the first layer to the interior surface, the first opening comprises a third end and a fourth end, and the third end is coupled to the first end of the groove;

a second opening, formed in the first layer in the base portion, wherein the second opening comprises a third width and a third depth, the third depth extends from at least the exterior surface of the first layer to the interior surface, the second opening comprises a fifth end and a sixth end, and the fifth end is coupled to the second end of the groove;

a first portion of an insert, formed in the first opening, wherein the first portion of the insert comprises a fourth width that is the same as the second width, and a thickness extending from at least the exterior surface of the first layer to the interior surface; and a second portion of the insert, formed in the groove, wherein the second portion of the insert comprises a fourth width that is the same as the first width, and a thickness extending from at least the exterior surface of the first layer to the groove bottom surface.

2. The case of claim 1 further comprising a third portion of the insert, formed in the second opening, wherein the third portion of the insert comprises a sixth width that is the same as the third width, and a thickness extending from at least the exterior surface of the first layer to the interior surface.

3. A case for a portable electronic device comprising:

a base portion comprising a first layer and a second layer, wherein the first layer is coupled to the second layer, the first layer comprises a first side and a second side, the second layer comprises a third side and a fourth side, the second side of the first layer is adjacent to the third side of the second layer, and a back of the electronic device contacts the first side of the first layer when placed inside the case;

first, second, third, fourth sidewalls coupled to the base portion, wherein the first second, third, and fourth sidewalls are configured to surround the electronic device, the first second, third, fourth sidewalls comprise the first and second layers, and the first and third sidewalls are shorter than the second and fourth sidewalls;

a first opening in the second layer extending partially across the base portion;

a second opening in the second layer extending partially across the base portion;

a filler extending from the second side of the first layer towards the fourth side of the second layer, wherein the filler is positioned to fill in the first and second openings in the second layer, and wherein the filler has an upper surface that is flush with the fourth side of the second layer.

4. The case of claim 3 wherein the first opening and the second opening are collinear.

5. The case of claim 3 wherein the first opening, the second opening, and the filler are collinear.

6. The case of claim 3 wherein the second layer comprises a rigid material and the first layer and filler comprises a more flexible material.

7. The case of claim 3 wherein the first opening extends from within the second sidewall.

8. The case of claim 7 wherein the second opening extends from within the fourth sidewall.

9. The case of claim 8 wherein the first layer further includes a plurality of openings that extend over the base portion in a pattern and wherein said second layer is formed of a translucent material to allow visibility of the first layer through the second layer.

* * * * *